US005495146A

United States Patent [19]

Saito et al.

[11] Patent Number: 5,495,146

[45] Date of Patent: Feb. 27, 1996

[54] PLANAR DISPLAY APPARATUS

[75] Inventors: Masato Saito; Ryo Suzuki; Keiji Fukuyama; Takuya Ohira; Keiji Watanabe, all of Kamakura; Minoru Kobayashi; Susumu Hoshinouchi, both of Amagasaki; Yoshinori Hatanaka, Hamamatsu, all of Japan

[73] Assignee: Mitsubishi Denki Kabushiki Kaisha, Tokyo, Japan

[21] Appl. No.: 7,912

[22] Filed: Jan. 22, 1993

Related U.S. Application Data

[63] Continuation of Ser. No. 648,031, Jan. 30, 1991, abandoned.

[30] Foreign Application Priority Data

Feb. 1, 1990 [JP] Japan ..... 2-22768
Feb. 21, 1990 [JP] Japan ..... 2-41601

[51] Int. Cl.[6] ..... G09G 3/10

[52] U.S. Cl. ..... 315/169.1; 313/103 CM; 313/400; 313/495

[58] Field of Search ..... 313/103 R, 103 CM, 313/495, 422, 399, 400; 358/217; 315/169.1

[56] References Cited

U.S. PATENT DOCUMENTS

| | | | |
|---|---|---|---|
| 4,160,310 | 7/1979 | Manns | 29/25.14 |
| 4,719,388 | 1/1988 | Oess | 313/422 |
| 4,937,491 | 6/1990 | Kauwenberg | 313/422 |
| 4,939,413 | 7/1990 | Tomii et al. | 313/422 |

FOREIGN PATENT DOCUMENTS

| | | | |
|---|---|---|---|
| 0107217 | 5/1984 | European Pat. Off. . | |
| 0213839 | 3/1987 | European Pat. Off. . | |
| 11756 | 1/1977 | Japan | 313/422 |
| 54-128666 | 4/1979 | Japan . | |
| 58-046562 | 3/1983 | Japan . | |
| 61-118951 | 10/1986 | Japan . | |
| 172642 | 7/1987 | Japan . | |
| 62-188128 | 8/1987 | Japan . | |
| 184239 | 7/1988 | Japan . | |
| 126688 | 5/1989 | Japan . | |

OTHER PUBLICATIONS

German Published Article vol. 31, No. 11, 1978 to Marten. Tannas, Jr., "Flat-Panel Displays and CRT's" Copyright 1985 by VanNostrand Reinbold Co., pp. 213-216.

*Primary Examiner*—Robert J. Pascal
*Assistant Examiner*—Michael Shingleton

[57] ABSTRACT

Planar display devices which have a small thickness and used as a display unit of a television set, a monitor or the like. A control electrode portion for passing electrons through a given electron-passing hole selected from a plurality of electron-passing holes provided on an insulating substrate is formed by coating the insulating substrate with a conductive film and dividing them into a plurality of conductive films as control electrodes. This structure obviates the mesh structure of electrons which are necessary in the case of arranging control electrodes on the insulating substrate, thereby realizing high-definition display devices with improved luminance. In addition, planar display devices provided with a surface insulated substrate produced by forming an insulating film on a conductive substrate having electron-passing holes and a plurality of separate control electrodes arranged on the surface insulated substrate, it is possible to prevent the charge-up effect which obstructs the passage of electron beams and, hence, to enhance the luminance by (1) providing a voltage applying means for applying a predetermined voltage to the conductive substrate, (2) providing a portion at which the conductive substrate is exposed between the adjacent control electrodes, and so on.

11 Claims, 13 Drawing Sheets

PLANAR DISPLAY APPARATUS

This application is a continuation of application Ser. No. 07/648,031 filed on Jan. 30, 1991, now abandoned.

BACKGROUND OF THE INVENTION

1. Field of the Invention

The present invention relates to a planar display apparatus utilizing an electron beam.

2. Description of the Related Art

FIG. 18 is a perspective view of a part of a conventional planar display apparatus described in, for example, Japanese Patent Laid-Open No. 184239/1988. In FIG. 18, the reference numeral 1 represents a linear hot cathode as an electron radiation source which emits electrons when electric conduction is established, the linear hot cathode 1 being connected to a holder (not shown). The reference numeral 2 denotes a mesh electrode having an oval cross-section and a multiplicity of small holes 3 for passing electrons therethrough. By applying an appropriate potential to the mesh electrode 2, electrons are taken out of the linear hot cathode 1. The reference numeral 4 represents a front glass (display screen) with the inside surface coated with dot-like three kinds of dot-like phosphor materials 5 which emit red, green and blue lights when excited by the electrons drawn out by the mesh electrode 2. On the fluorescent substances 5, an aluminum film (not shown) is provided for imparting conductivity. By applying a voltage of about 10 to 30 KV to the aluminum film, the electrons are accelerated and excite the fluorescent substances 5 so as to emit light.

The referential numeral 6 represents a control electrode portion disposed between the front glass 4 and the linear hot cathode 1 in close proximity thereto so as to allow or obstruct the passage of the electrons which are taken out by the mesh electrode 3 and directed toward the front glass 4. As shown in the exploded view of the structure of the control electrode portion 6 in FIG. 19, the control electrode portion 6 is composed of an insulating substrate 8 having electron-passing holes 7 which correspond to the picture elements on the front glass 4, a first control electrode group 9 provided on the undersurface of the insulating substrate 8 and a second control electrode group 10 provided on the upper surface of the insulating substrate 8. The first control electrode group 9 is composed of a plurality of strip metal electrodes **9*a*. The metal electrode 9*a* is provided with electron passing portions 9*b* which correspond to the respective picture elements in one row. Similarly, the second control electrode group 10 is composed of a plurality of strip metal electrodes 10*a*. The metal electrode 10*a* are provided with electron passing portions 10*b*** which correspond to the respective picture elements in one vertical line.

Each of the electron passing portions **9*b*, as well as the electron passing portions 10*b*, is a reticulate portion produced by making a multiplicity of small holes 11 in the metal electrodes 9*a* (10*a*) at the portion corresponding to each of the electron-passing holes 7 in the insulating plate 8, as shown in an enlarged view of FIG. 20**.

The periphery of the front glass 4 extends downward in a curved state and is closed (not shown) below a rear electrode 12. The interior of the front glass 4 is maintained at a vacuum. Each electrode in the sealed glass container is electrically connected to the external elements from the sealing portion provided on the side surface.

The operation of the conventional planar display apparatus will now be explained. Electrons are drawn out of the linear hot cathode 1 by the porous cover electrodes 2. The electrons are attracted to the first control electrode group 9 and reach the control electron portion 6.

The voltage applied to each electrode will here be explained on the assumption that the average voltage applied to the linear hot cathode 1 is 0 V as a reference voltage. To the mesh electrode 2, a voltage about 5 to 30 V higher than the voltage applied to the linear hot cathode 1 is applied. To the metal electrode **9*a* of the first control electrode group 9, a positive potential about 20 to 40 V higher than the potential applied to the linear hot cathode 1 is applied. This voltage is only applied to one metal electrode 9*a* of the first electrode group 9 at a time, which are arranged orthogonally to the linear hot cathode 1**.

The electron current density on the front surface of the metal electrode **9*a* is preferably substantially uniform. It is possible to make the electron current density uniform by controlling the oval cylinder shape of the mesh electrode 2, the position of the first control electrode group 9 and the voltage applied to each metal electrode 9*a***.

The operation of the control electrode portion 6 is not described in Japanese Patent Laid-Open No. 184239/1988 but described in, for example, Japanese Patent Laid-Open Nos. 172642/1987 and 126688/1989. In the general matrix type display described in these documents, the operation of the control electrode portion 6 is as follows. As described above, only one metal electrode **9*a* in the first control electrode group 9 becomes a positive potential and the other metal electrodes 9*a* have 0 V or a negative potential. In this case, the electrons emitted from the linear hot cathode 1 are attracted only to this one metal electrode 9*a* having a positive potential. The electrons pass through the electron passing portions 9*b* of the metal electrode 9*a* and enter the respective electron-passing holes 7 of the insulating substrate 8. All the electrons which have entered the electron-passing holes 7 do not reach the front glass 4. In other words, of the second control electrode group 10 disposed above the electron-passing holes 7, the electrons pass only through the electron passing portions 10*b* of the metal electrode 10*a* to which a potential of, for example, 40 to 100 V is applied and do not pass through the electron passing portions 10*b* of the other metal electrodes 10*a* which have 0 V or a negative potential. The electrons at these portions stay in the electron-passing holes 7. Consequently, the electrons pass only through the electron-passing hole 7 at the intersection of the one metal electrode 9*a* of the first control electrode group 9 to which a positive potential is applied so as to turn it on and the metal electrode 10*a* of the second control electrode group 10 to which a positive potential is applied. The electrons which have thus passed through the electron-passing hole 7 cause the fluorescent substance 5, at the position of the picture element which corresponds to the electron-passing hole 7, to emit light for displaying a picture on the screen. Therefore, by so controlling the application of the potential to each of the metal electrodes 9*a* and 10*a* that the intersection corresponds to a desired light emitting position, a desired picture display is realized. For example, a picture is displayed by consecutively scanning and turning on the metal electrodes 9*a* of the first control electrode group 9 one by one and, synchronously therewith, consecutively turning on the metal electrodes 10*a* of the second control electrode group 10** which correspond to the respective light emitting positions. This scanning operation is repeated for a period which is imperceptible to the human eyes, for example, 60 frames per second.

The electron passing portions **9*b* and 10*b*, which are reticulate portions produced by making a multiplicity of small holes 11 in the metal electrodes 9***a* and 10*a*, respectively, as explained above with reference to FIG. 20, are so designed as to obstruct the passage of electrons when 0 V or a negative potential of several 10 V is applied to each of the control electrodes 9 and 10.

The luminance of each picture element is controlled by the time for which each metal electrode 10*a* of the second control electrode group 10 is on. If it is assumed that the time for which the first control electrode group 9 is on is $T_1$ and if the luminance of the picture element at a predetermined position is intended to be P%, the time for which the metal electrode 10*a* of the second control electrode group 10 which corresponds to that position is on is set at $P.T_2/100$.

In such a conventional planar display apparatus, each of the first control electrode group 9 and the second control electrode group 10 must be composed of strip electrodes arranged in each row and each vertical line, respectively. Use of such a strip electrode is disadvantageous because there is a limitation in finer and more accurate displaying function of a planar display apparatus due to the limitation in the accuracy in processing the strip electrodes.

There is also a great trouble in the manufacture of the strip electrodes such as difficulty of fixing and holding them separately from each other.

In addition, since the electron passing portion has a reticulate structure provided with a multiplicity of small holes, electrons hit against the reticulate portion when they pass through the electron passing portion and the lowering of the electron passing ratio, which may lead to the reduction in the luminance of the planar display apparatus, is inevitable.

As to the luminance, electrons are gradually attached to the portions of the surface of the insulating substrate 8 which are not covered with the metal electrodes of the first and second control electrode groups, and the potentials of these portions become negative (this phenomenon is called charge-up effect). When the time has come that a positive potential is applied to the metal electrode so as to turn it on and pass electrons through insulating plate 8, the negative potential due to the electrons which have been attached to those portions greatly obstructs the passage of the electrons, thereby lowering the display more than the desired luminance.

SUMMARY OF THE INVENTION

Accordingly, it is an object of the present invention to eliminate the above-described problems in the related art and to provide a planar display apparatus which has a simple structure and excellent processability and which heightens the reliability of the operations of the electrodes, improves the luminance and enables finer and more accurate display.

To achieve this aim, a planar display apparatus of the present invention comprises: an electron emission source for emitting electrons to a phosphor screen provided in a sealed container; and a control electrode portion interposed between the electron emission source and the phosphor screen and produced by coating a surface insulated substrate having a plurality of electron-passing holes with a conductive film to which a passing electron controlling potential is applied and which is divided into a plurality of conductive films as control electrodes.

In order to ensure the passage and the obstruction of the passage of electrons, the conductive film is provided on the inner wall surface of the electron-passing hole. Especially, when the film is provided on the inner wall to a depth of not less than ¼ of the diameter of the electron-passing hole, the effect is prominent.

In order to enhance the electron passing ratio, the inner wall surface of the electron-passing hole is coated with a material having a secondary-electron emission capacity larger than the insulated surface portion of the surface insulated substrate.

In order to focus the electrons which have passed through the control electrodes, a focusing electrode is preferably provided between the phosphor screen and the control electrode portion.

The surface insulated film is preferably composed of a metal substrate provided with an insulation layer on the surface thereof in order to facilitate processing of the insulating substrate 8. If the material of the metal substrate has a linear expansion coefficient of not more than $3\times10^{-5}$/deg at a temperature of room temperature to about 500° C., it is possible to prevent the deterioration caused by a temperature change.

The control electrode portion is produced by forming surface hole portions in the insulating substrate except for the portions at which inner hole portions are formed, covering the insulating substrate with a conductive film to which a passing electron controlling potential is applied, and piercing the remaining portions from the surface hole portions so as to form the inner hole portions.

A planar television set is produced by using the planar display apparatus and providing a receiving means for receiving television waves and a display control means for displaying the signal received by the receiving means on the planar display apparatus.

To sum up, in one aspect of the present invention, there is provided a planar display comprising: an electron emission source for emitting electrons to a phosphor screen provided in a sealed container; a surface insulated substrate interposed between the electron emission source and the fluorescent substrates and composed of a conductive substrate having a plurality of electron-passing holes and coated with an insulating film; a plurality of control electrodes which are provided on the surface insulated substrate separately from each other and to which a passing electron controlling potential is applied; and a voltage applying means for applying a predetermined voltage to the conductive substrate of the surface insulated substrate.

If the voltage applying means is composed of a pulse voltage applying device for applying to the conductive substrate a pulse voltage the lowest value of which is not less than 10 V lower than the lowest voltage of the passing electron controlling voltage which is applied to the control electrodes, it is effective for preventing the charge-up effect.

In another aspect of the present invention, there is provided a planar display comprising: an electron emission source for emitting electrons to a phosphor screen provided in a sealed container; a surface insulated substrate interposed between the electron emission source and the fluorescent substrates and composed of a conductive substrate having a plurality of electron-passing holes and coated with an insulating film; a plurality of control electrodes which are provided on the surface insulated substrate separately from each other and to which a passing electron controlling potential is applied; and a conductor exposing portion provided on the surface insulated substrate between every adjacent control electrodes so as to expose the conductor substrate.

In still another aspect of the present invention, there is provided a planar display apparatus comprising:

an electron emission source for emitting electrons to a phosphor screen provided on the inside of a sealed container;

a surface insulated substrate provided between the electron emission source and the phosphor screen and provided with a plurality of electron-passing holes; and control electrodes which are formed on the surface insulated substrate and to which a passing electron controlling potential is applied;

each of the control electrodes satisfying the following conditions on the assumption that the thickness of the conductive is t μm and the space between the adjacent conductive films is d μm:

$$d/t \leqq 5,\ d \leqq 100$$

In a planar display apparatus according to the present invention, the electrons emitted from the electron emission source pass through the electron-passing hole in the vicinity of a conductive film of the plurality of conductive films of the control electrode portion to which a predetermined potential is applied and do not pass through the other electron-passing holes. The electrons which have passed through the electron-passing hole cause the phosphor screen to emit light, thereby enabling free control of the display by the application of a potential to the conductive film of the control electrode portion. The control electrode portion is composed of a surface insulated substrate having a plurality of electron-passing holes and a conductive film to which a passing electron controlling potential is applied and which is separated into a plurality of films so as to coat the surface insulated substrate. Thus, the control electrode portion has a fine structure provided with electron-passing holes having a small hole diameter and a small hole pitch as compared with the control electrode portion using strip electrodes. Since it is possible to produce the electron-passing hole having a small diameter, the passage of electrons can be easily controlled without the need for providing a conductor in the electron-passing hole.

By coating the inner wall surface of the electron-passing hole with a conductive film to a depth of not less than ¼ of the diameter of the electron-passing hole, it is possible to produce a sufficient electric field in the electron-passing hole.

By coating the inner wall surface of the electron-passing hole with a material having secondary-electron emission capacity larger than the insulated surface portion of the surface insulated substrate, the electron passing ratio is enhanced.

In addition, if a focusing electrode is provided between the phosphorescent substances and the control electrode portion, the electrons which have passed through the control electrodes are converged, thereby improving the picture quality.

If the surface insulated film is composed of a metal substrate provided with an insulation layer on the surface thereof, processing is facilitated. If the material of the metal substrate has a linear expansion coefficient of not more than $3\times10^{-5}$/deg at a temperature of room temperature to about 500° C. it is possible to prevent the deterioration caused by a temperature change during the manufacture and during use.

The control electrode portion is produced by forming surface hole portions in the insulating substrate except for the portions at which inner hole portions are formed, covering the upper surface and undersurface of the insulating substrate with a conductive film to which a passing electron controlling potential is applied, and piercing the remaining portions from the surface hole portions of the insulating substrate so as to form the inner hole portions.

If a receiving means for receiving television waves and a display control means for displaying the signal received by the receiving means on the planar display apparatus are further provided, a thin planar television set is realized.

In the planar display apparatus of the present invention, since the surface insulated substrate is produced by coating a conductive substrate with an insulating film and a predetermined voltage is applied to the conductive substrate by a voltage applying means, it is possible to make the portions of the surface insulated substrate which are not coated with the control electrodes to have a potential which is unlikely to attract electrons, thereby reducing the possibility of causing a charge-up effect.

If a pulse voltage, the lowest value of which is not less than 10 V lower than the lowest voltage of the passing electron controlling voltage applied to the control electrodes, is applied to the conductive substrate by a pulse applying device which is provided as the voltage applying means, the electrons which have been attached to the insulating film are separated therefrom by the electric field produced on the conductive substrate by the pulse voltage. This thereby reduces the possibility of causing a charge-up effect.

In the second aspect of the present invention, since the surface insulated substrate interposed between the electron emission source and the fluorescent substrates is composed of a conductive substrate having a plurality of electron-passing holes and coated with an insulating film, and a conductor exposing portion at which the conductive substrate is exposed, is provided on the surface of the surface insulated substrate between every adjacent control electrodes of a plurality of them provided on the surface insulated substrate separately from each other, electrons do not stay at the conductor exposing portions which are not covered with the control electrodes. Thus, the area of the portion at which electrons are stored is reduced. This thereby reduces the possibility of causing a charge-up effect.

In the third aspect of the present invention, since the control electrodes, provided on the surface insulated substrate separately from each other, which is interposed between the electron emission source and the fluorescent substrates and which have a plurality of electron-passing holes, are so designed that the height t μm of the control electrode at the end portions and the space d μm between the adjacent control electrodes have the following relationship:

$$d/t \leqq 5,\ d \leqq 100,$$

the area of the portion which is not covered with the control electrode and attracts electrons is reduced. Further, the electrons which have been attached to the portion move to the control electrode situated in close proximity thereto. In addition, the unnecessary electric field produced by the electrons which have been attached to the portion is unlikely to reach the orbit of the passing electrons due to the thickness of the control electrode. Thus, the lowering of the luminance due to the charge-up effect is prevented.

The above and other objects, features and advantages of the present invention will become clear from the following description of the preferred embodiments thereof, taken in conjunction with the accompanying drawings.

DESCRIPTION OF THE PREFERRED EMBODIMENTS

Figures 1, 1A:
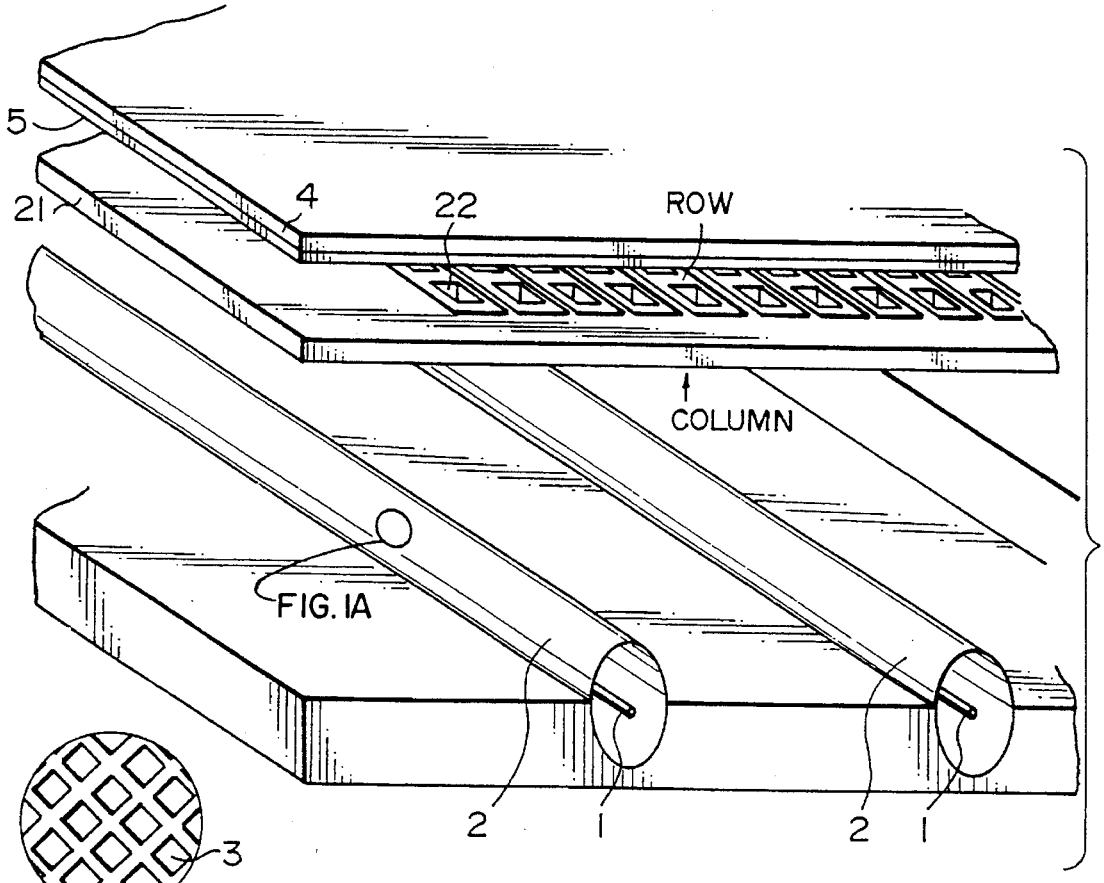
FIGS. 1 and 1A are a perspective view of a part of a first embodiment of a planar display apparatus according to the present invention.
Figure 2:
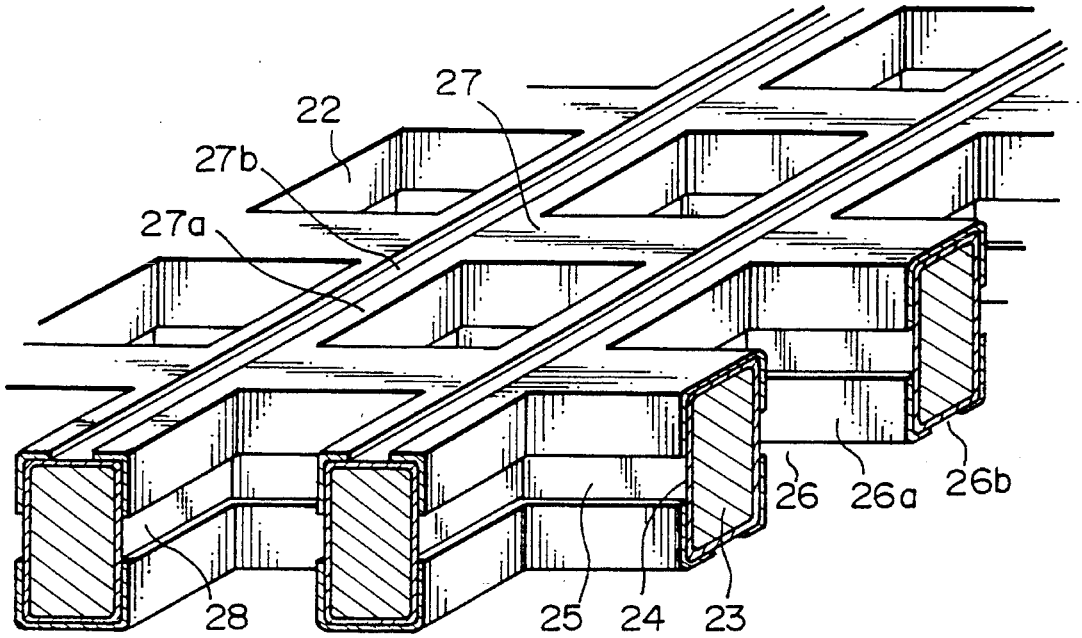
FIGS. 2 and 3 are enlarged partially sectional perspective views of the control electrode portion of the first embodiment.
Figure 3:
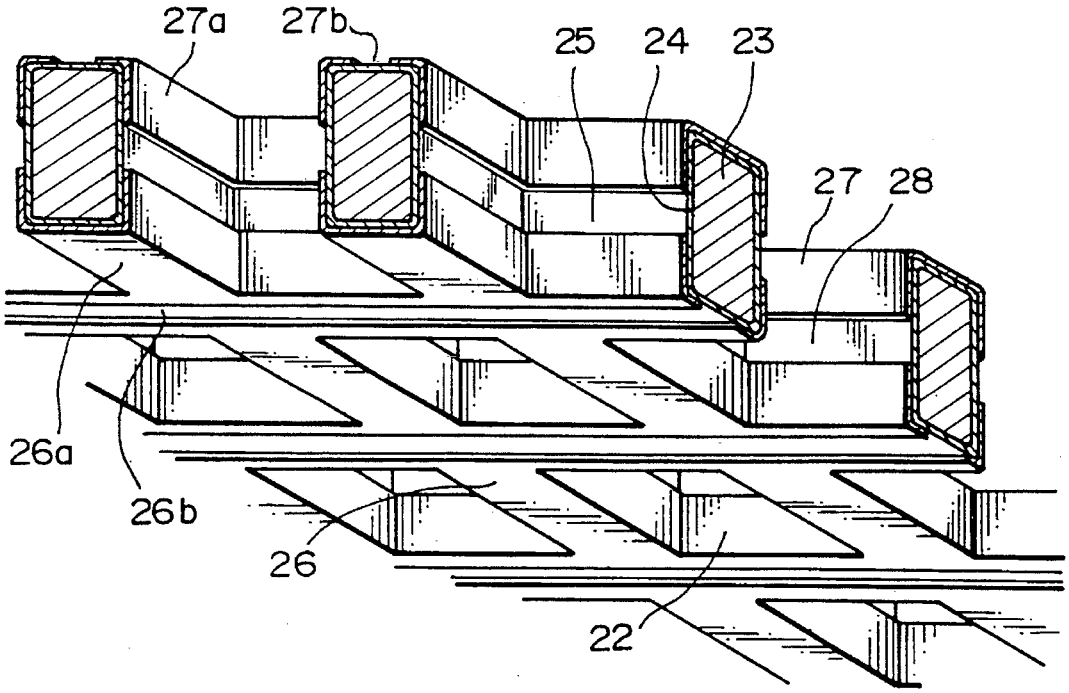

Embodiments of the present invention will be explained hereinunder with reference to the accompanying drawings. FIGS. 1 and 1A are a perspective view of a first embodiment of a planar display apparatus according to the present invention. The reference numerals 1 to 5 denote the same elements as those in the conventional apparatus. The reference numeral 21 represents a control electrode portion disposed between the front glass 4 and the linear hot cathodes 1 in close proximity thereto. The control electrode portion 21 has a multiplicity of electron-passing holes 22 which correspond to the picture elements of a screen and allow or obstruct the passage of the electrons which are drawn out of the porous cover electrodes 3 and directed toward the front glass 4. FIGS. 2 and 3 are enlarged partially sectional perspective views of the control electrode portion 21, viewed from above and below, respectively. The reference numeral 23 represents a conductive substrate having the electron-passing holes 22 for passing electrons therethrough and made of stainless steel, aluminum or the like. The reference numeral 24 denotes an insulating film of alumina, silica or the like which is formed on the entire surface of the conductive substrate 23 including the inner wall surfaces of the electron-passing hole 22 to a thickness of 30 μm. A surface insulated substrate 25 is produced by coating the conductive substrate 23 with the insulating film 24.

The reference numeral 26 represents a first control conductive film group. It, after, is coated with the insulating film 24 on the undersurface side of the surface insulated substrate 25. The first control conductive film group 26 is composed of a conductive film of a conductive material such as nickel which is divided into a plurality of films 26*a* (first control electrodes) along each row of electron-passing holes 22 so as to form a substrate exposing portion 26*b* between every adjacent conductive films 26*a*.

The reference numeral 27 represents a second control conductive film group with which is coated the insulating film 24 on the upper surface side of the surface insulated substrate 25. The second control conductive film group 27 is composed of a conductive film which is divided into a plurality of films 27*a* (second control electrodes) along each vertical line of electron-passing holes 22 so as to form a substrate exposing portion 27*b* between every adjacent conductive films 27*a*.

The coating of the insulating film 24 with these first and second control conductive film groups 26 and 27 extends to the inside wall surfaces of the electron-passing holes 22. Between the first and second control conductive film groups 26 and 27, the insulating film 24 is exposed, thereby forming a substrate exposing portion 28 which electrically isolates the conductive film groups 26 and 27 from each other. As described above, in each of the first and second control conductive film groups 26 and 27, the conductive films 26*a* on the adjacent rows or the conductive films 27*a* on the adjacent vertical lines are also electrically separated from each other by the substrate exposing portions 26*b* or 27*b*. Owing to this structure, it is possible to apply different potentials to the conductive films 26*a* or 27*b* depending on the row or vertical line.

In order to produce the control electrode portion 21, an aluminum plate of 0.5 mm thick is used as the conductive substrate 23 and the electron-passing holes of 22 of 0.4 mm square each are formed by, for example, etching. An Alumite layer of about 30 μm thick is then formed as the insulating film 24 by, for example, anodic oxidation. A conductive film of a nickel film of about 10 μm is formed while keeping the substrate exposing portions 26*b*, 27*b* and 28 by using a technique of electroless plating and masking, for example, thereby forming the first and second control conductive film groups 26 and 27. The depth of the conductive film on the inner wall surface of the electron-passing hole 22 is 0.2 mm both in the first and second control conductive film groups 26 and 27. The width of the substrate exposing portion 28 is 0.1 mm.

The dots and the pitches of the phosphorescent substances 5 on the front glass 4 are formed in correspondence with the electron-passing holes 22 of the control electrode portion 21.

Figure 17:
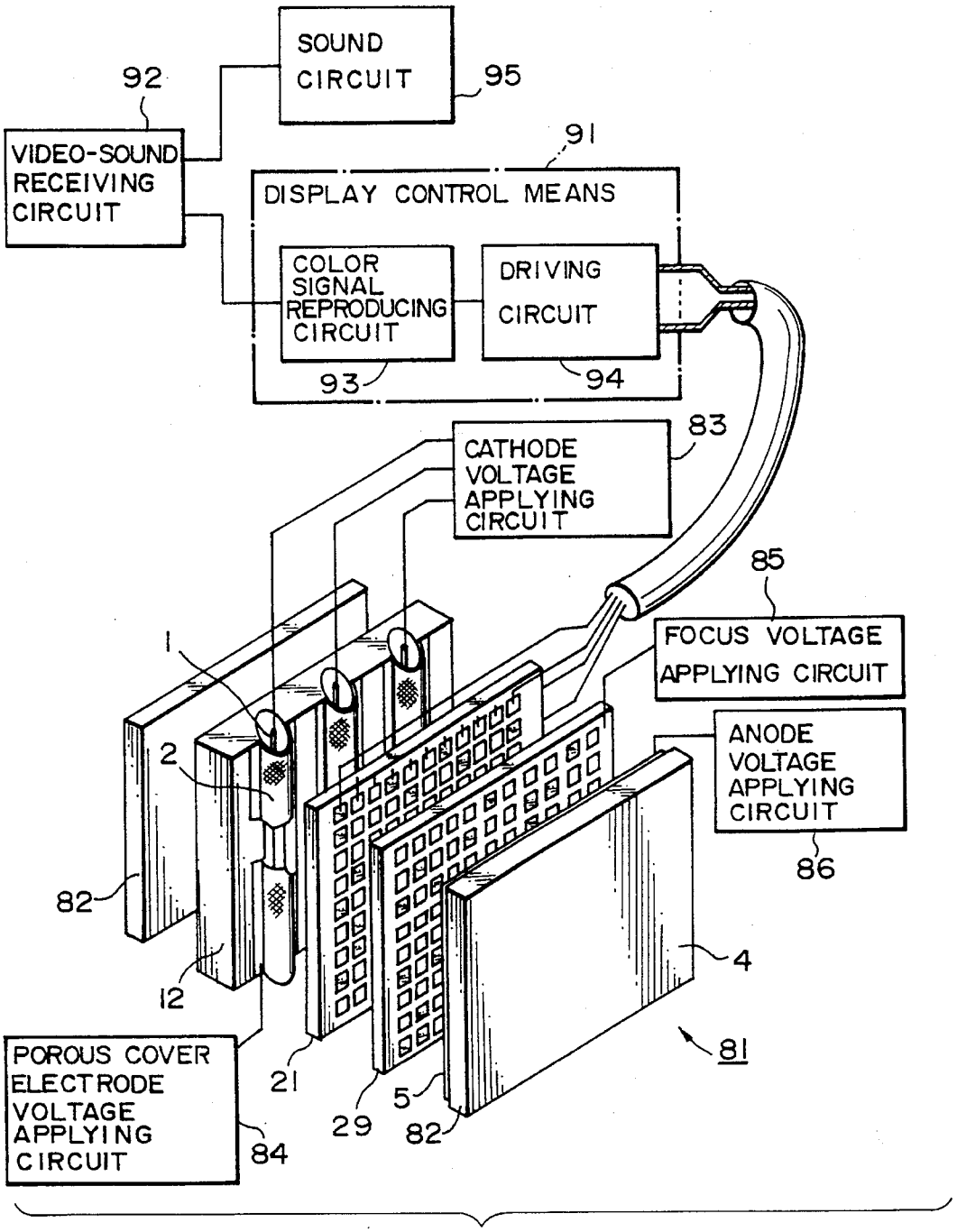
FIG. 17 is an exploded view of the structure of a planar television set in accordance with the present invention.
Figures 18, 18A:
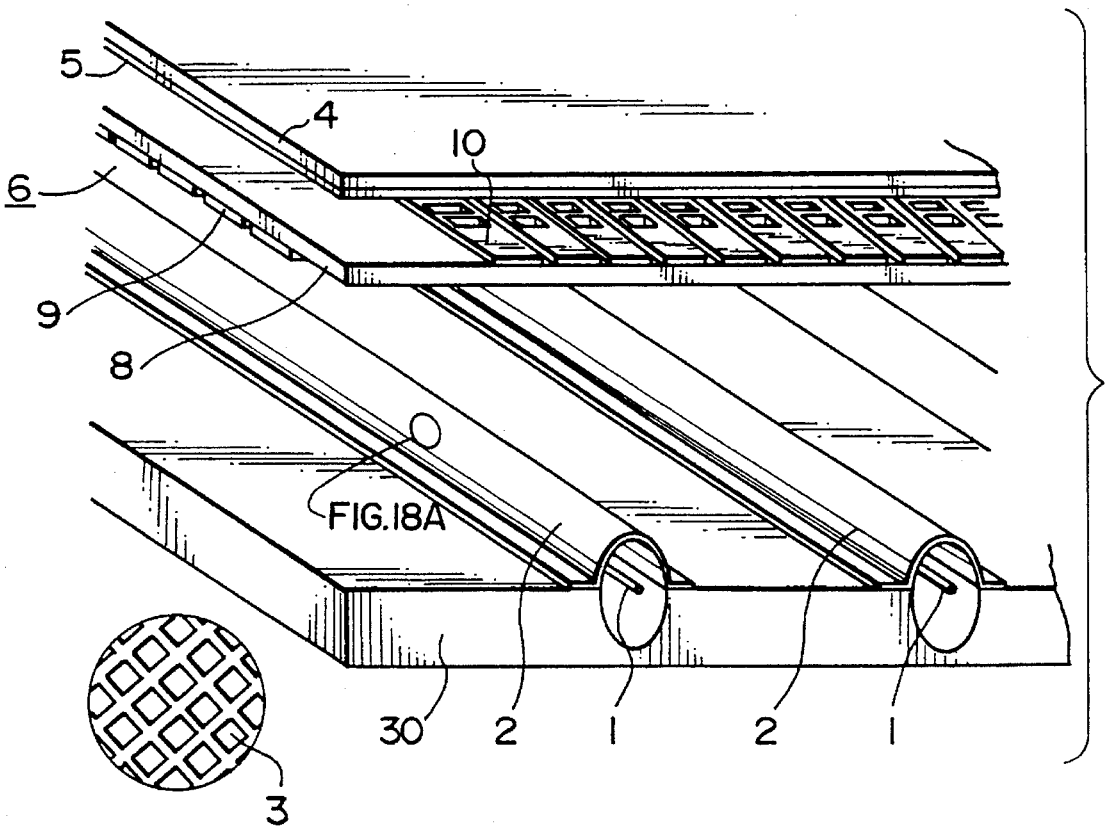
FIG. 18 PRIOR ART
FIGS. 18 and 18A are a perspective view of a conventional planar display apparatus.

A converging electrode plate 29 for converging the electrons which have passed through the control electrode portion 21 is disposed between the front glass 4 and the control electrode portion 21, as shown in FIG. 17. The converging electrode plate 29 is provided on top of the second control conductive film group 27 of the control electrode portion 21 by, for example, etching a stainless steel plate of 0.45 mm thick having holes of 0.45 mm square each. There are arranged at the same pitch as the electron-passing holes 22 of the control electrode portion 21. The undersurface of the converging electrode plate 29, namely, the surface which comes into contact with the second control conductive film group 27 in FIG. 2 is coated with an insulating layer of a polyimide resin or the like so as to allow the application of a different potential from that applied to the second control conductive film group 27 to the converging electrode plate 29.

In the planar display apparatus having the above-described structure, it is possible to control the light emission of the phosphorescent substances 5 in each picture element and display a desired picture by applying potentials for controlling the passage of electrons to the first and second control conductive film groups 26 and 27 as in the conventional apparatus. When the on/off operations of the electrodes were confirmed by applying voltages of the same level as in the conventional apparatus to the first and second control conductive film groups 26 and 27 and the light emitting state of the phosphorescent substances 5 was observed, a sufficient display function was confirmed.

In order to ensure the off-operation, it is necessary to produce a sufficient electric field for preventing the passage of electrons through the electron-passing hole 22. Such an electric field is effectively produced by the conductive film with which the inner wall surface of the electron-passing hole 22 is coated. The conductive film coats the inner wall surface of the electron-passing hole 22 to a depth of not less than ¼, more preferably not less than ½ of the diameter of the electron-passing hole 22.

In this embodiment, the electron-passing hole 22 has a square shape, but a similar effect is produced by the electron-passing hole 22 of a round or another shape.

Although the coating of the insulating film 24 with these first and second control conductive film groups 26 and 27 extends to the inside wall surfaces of the electron-passing holes 22 in this embodiment, it may be restricted to the insulating film on the upper surface side and the undersurface of side of the surface insulated substrate 25. In this case, in order to facilitate the on/off control of the electrodes by the passing electrodes, the conductive films of the first and second control conductive film groups 26 and 27 are preferably formed as thick films having a thickness of not less than ¼ of the diameter of the electron-passing hole 22 by printing or the like. For example, if the electron-passing hole 22 has a rectangular shape, the thickness of the conductive film is not less than ¼ of the short side of the rectangle and if the electron-passing hole 22 has a round shape, the thickness of the conductive film is not less than ¼ of the diameter.

In this embodiment, the surface insulated substrate 25 is produced by forming the insulating film 24 of an Alumite layer on the surface of the conductive substrate 23 of aluminum, but the surface insulated substrate 25 may be produced by forming an insulation layer of an oxide, a nitride or a polyimide resin on the surface of a metal plate other than an aluminum plate by, for example, deposition. It is also possible to use an insulating glass or ceramic material for the surface insulated substrate 25. However, from the point of view of the processability and the efficiency, a metal substrate provided with an insulation layer is the most suitable as the surface insulated substrate 25. This is because a metal substrate is easy to process when forming the electron-passing holes 22. Further, the use of a combination of a metal substrate and an insulation layer can prevent the insulation layer from separating from the metal substrate during the heating process in the manufacture of a planar display apparatus or when the temperature is raised by an electron beam during the operation of the apparatus. In addition, such surface insulated substrate 25 is effective for preventing the electrons from being attached to the electron-passing holes 22 (charge-up effect).

In order to prevent the insulating film from separating from the metal substrate, the metal substrate preferably has a linear expansion coefficient of not more than $3\times10^{-5}$/deg, more preferably not more than $1\times10^{-5}$/deg at a temperature ranging from room temperature to about 500° C. Examples of a preferable material of a metal substrate are niobium, chromium, iridium, tantalum, platinum and tungsten. Use of these metal substrates can prevent the insulating film having an excellent insulation property such as aluminum oxide, silicon oxide and magnesium oxide films from separating from the substrates.

In this embodiment, since the insulating film 24 on the upper surface side is coated with the second control conductive film group 27 down to the inner wall surface of the electron-passing holes 22, an electromagnetic lens is formed in the interior (the direction of depth) of the electron-passing hole 22 so as to receive the operation of the electrons which have passed the electron-passing holes 22. The converging electrode plate 29 for converging the electrons which have passed through the control electrode portion 21 so as to prevent the electrons from flying out of a predetermined range is disposed between the front glass 4 and the control electrode portion 21, as shown in FIG. 17. As a result, the picture quality such as the contrast is improved.

It is also possible to prevent the charge-up effect or increase the amount of the electron beam radiated onto the phosphorescent substances 5 and enhance the luminance by coating at least a part of the substrate exposing portions 28 in the electron-passing holes 22 with a material having a high secondary-electron emission ratio such as magnesium oxide, beryllium and copper.

Figures 4, 4A:
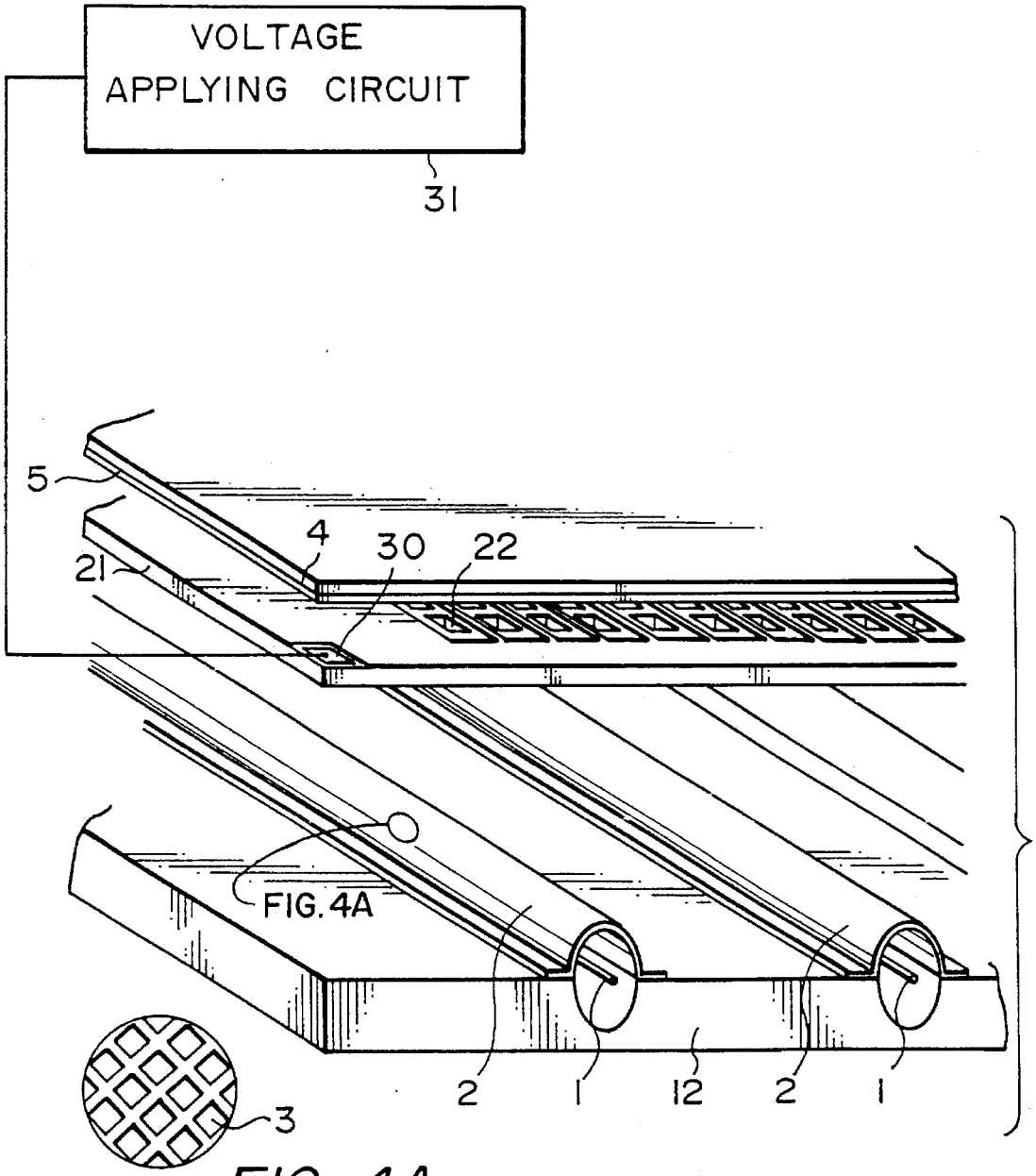
FIGS. 4 and 4A are a perspective view of a part of a second embodiment of a planar display apparatus according to the present invention.

FIGS. 4 and 4A are a perspective view of a part of a second embodiment of a planar display apparatus according to the present invention.

A first characteristic feature of this embodiment is that a conductive substrate exposing portion 30 which is not coated with the insulating film 24 is provided at one corner portion of the control electrode portion 21. A second characteristic feature of this embodiment is that a voltage applying circuit 31 for applying a predetermined voltage is connected to the conductive substrate exposing portion 30.

In the planar display apparatus having the above-described structure, it is possible to control the light emission of the phosphorescent substances 5 for each picture element and display a desired picture by applying potentials for controlling the passage of electrons to the first and second control conductive film groups 26 and 27 under the same voltage applying conditions as those in the conventional apparatus.

It is now assumed that a voltage of 20 to 40 V is applied to the n-th conductive film 26*a* of the first control conductive film group 26 so as to turn on the conductive film 26*a* and a voltage of 0 to −10 V, e.g., −3 V is applied to the other conductive films 26*a* to turn them off. In this case, the electrons which have passed through the porous cover electrodes 2 only reach the conductive film 26*a* in the on state without reaching the conductive films 26*a* in the off state depending upon the potentials. Therefore, the electrons are not attached to the substrate exposing portions 28 of the electron-passing holes 22 which are coated with the conductive films 26*a* other than the n-th conductive film 26*a*. As to the surface exposing portions 26*b* between the conductive films 26*a* of the first control conductive film group 26, no electrons reach the surface exposing portions 26*b* except the surface exposing portion 26*b* between the (n−1)th conductive film and the n-th conductive film and the surface exposing portion 26*b* between the n-th conductive film and the (n+1)th conductive film. In the surface exposing portions 27*b* of the second control conductive film group 27, even if the electrons are attached thereto, since the electrons flow from the side of the first control conductive film group 26 and the voltage applied to the front glass 4 is so large that the influence of the electrons attached thereto on the electric field is small, the display luminance is not influenced and the lowering of the luminance is not observed.

The above-described operation is the same as in the conventional apparatus or in the case of using a mere insulating plate as the surface insulated substrate. In these conventional apparatus, when the n-th conductive film 26*a* is turned on, the electrons enter the electron-passing hole 22 coated with the n-th conductive film 26*a* and a part of the electrons collide with and are attached to the surface exposing portion 28 which is in close proximity to the n-th conductive film 26*a*. The electrons which have once been attached to the exposed surface portion 28 are difficult to separate and the number of the electrons attached thereto gradually increases. These electrons strengthen the electric field and, at last, exert influence on the electrons which are going to pass through the electron-passing hole 22 and darken the display of the corresponding picture element.

In this embodiment, however, the surface insulated substrate 25 is produced by coating the conductive substrate 23 with the insulating film 24, and a voltage lower than the voltage applied to the first control conductive film group 26 in the on state is applied to the conductive substrate exposing portion 30 by the voltage applying circuit 31. A constant voltage of the same degree as the potential of the second control conductive film group 27 in the off state, e.g., −3 V is applied to the conductive substrate exposing portion 30, namely, the conductive substrate 23. When a voltage of −3 V is applied to the conductive substrate 23 in this way, the potential of the surface of the conductive substrate 23 becomes low through the insulating film 24, so that no electrons are attached thereto. Therefore, by turning on the n-th conductive film 26*a*, as described above, even when the electrons enter the electron-passing hole 22 coated with the n-th conductive film 26*a*, they are not attached to the surface exposing portion 28. Consequently, in this embodiment, the luminance is not lowered by the charge-up effect, unlike in the above-described conventional devices, and it is possible to obtain a displayed screen with a desired luminance and a stable and uniform lightness.

In this structure, the insulating film 24 is ineffective if the thickness thereof exceeds 100 μm. This is because the electric field from the conductive substrate 23 does not reach the surface of the insulating film 24. If the thickness is not more than 100 μm, the insulating film 24 is effective and especially effective if the thickness is not more than 30 μm. So long as the withstand voltage is enough, the thinner the insulating film, the more effective it is.

The voltage applied to the conductive substrate 23 is effective if it is lower than the voltage applied to the first control conductive film group 26 in the on state. However, if the voltage applied exceeds that voltage, it has an adverse effect. Furthermore, if the voltage applied is not more than 0 V, an unfailing effect is obtained. Especially, if the voltage is lower than the voltage applied to the second control conductive film group 27 in the off state, a more decisive effect is obtained. The lower the voltage, the larger the effect.

The results of experiments carried out by varying the thickness of the insulating film 24 and the voltage applied to the conductive substrate 23 are shown in Table 1.

TABLE 1

| Thickness of insulating film (μm) | Voltage applied to conductive substrate (V) | Evaluation |
|---|---|---|
| 150 | 0 | x |
| | −30 | x |
| | −100 | o |
| 100 | 50 | x |
| | 40 | o |
| | 0 | o |
| | −3 | o |
| | −20 | o |
| | −100 | ⊚ |
| 50 | 40 | o |
| | 0 | ⊚ |
| | −3 | ⊚ |
| | −20 | ⊚ |
| | −100 | ⊚ |
| 30 | 40 | o |
| | 0 | ⊚ |
| | −3 | ⊚ |
| | −20 | ⊚ |
| | −50 | ⊚ |

In these experiments, the control voltages applied to the first and second control conductive film groups 26 and 27 so as to turn them on were 40 V and 60 V, respectively, and the control voltage applied to them so as to turn them off was −3 V. The voltage applied to the porous cover electrodes 3 was 7 V. Evaluation in Table 1 shows the results of the comparison between the surface insulated substrate 25 and a mere insulating substrate, and the mark x indicates that no effect was observed. Further, the mark O indicates that an effect was observed, and the mark ⊚ indicates that no charge-up effect was observed in ordinary operation. In other words, the effect of the planar display apparatus was decisive.

Although alumina is used for the insulating film 24 in this embodiment, the use of a silica insulating film or an insulating film of an organic material such as a polyimide resin also brings about the same effect.

The control voltages applied to the first and second control conductive film groups 26 and 27 so as to turn them on, the control voltage applied to them so as to turn them off, and the voltage applied to the porous cover electrodes shown in this embodiment are not restricted to 40 V, 60 V −3 V and 7 V, respectively. For example, when a voltage of 10 to 80 V and a voltage of 20 to 120 V were applied to the first control conductive film group 26 and the second control conductive film group 27, respectively, so as to turn them on, voltages of 0 to −10 V were applied to them independently of each other so as to turn them off and a voltage of 5 to 40 V was applied to the porous cover electrodes 3, similar effects were obtained.

Figure 5:
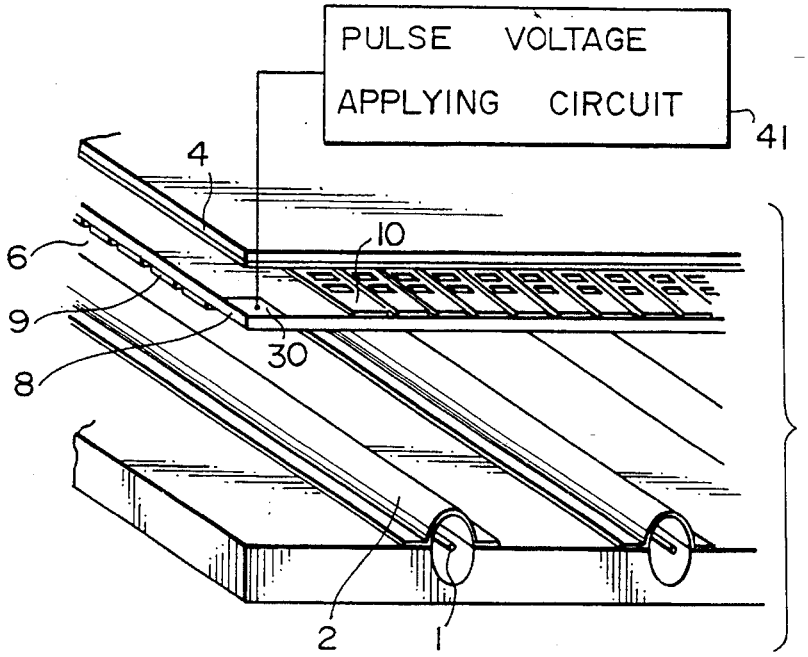
FIG. 5 is a perspective view of a part of another embodiment of a planar display apparatus according to the present invention.
Figure 6:
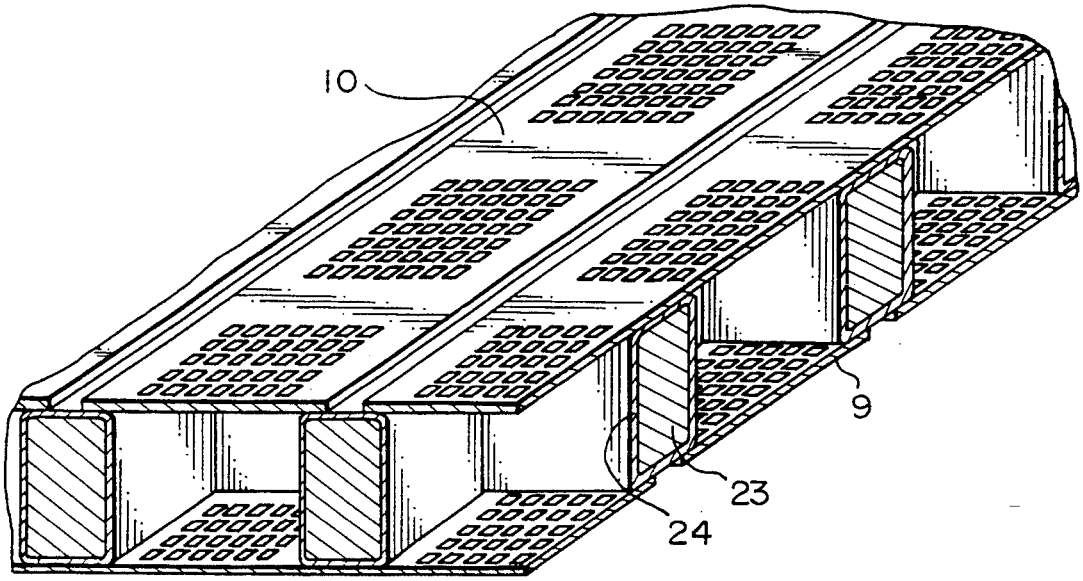
FIG. 6 is an enlarged partially sectional perspective view of the control electrode portion of the embodiment shown in FIG. 5.
Figure 19:
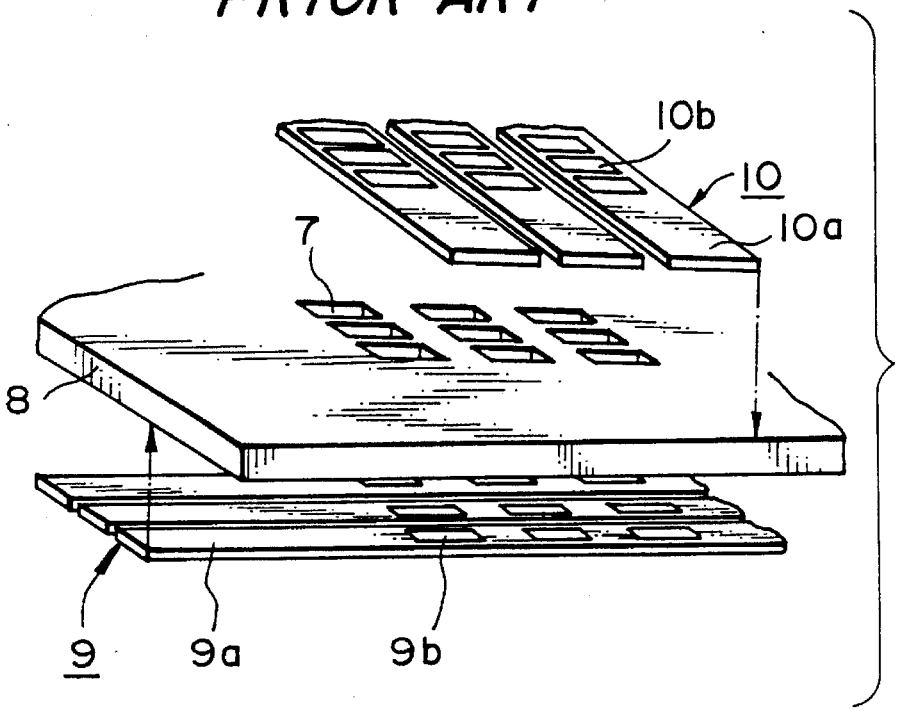
FIG. 19 PRIOR ART
FIG. 19 is a perspective view of a part of the control electrode portion of the conventional planar display apparatus shown in FIGS. 18 and 18A.
Figure 20:
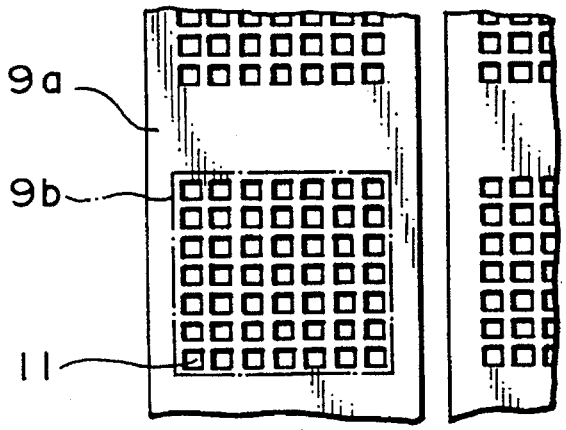
FIG. 20 PRIOR ART
FIG. 20 is an enlarged view of a part of a metal electrode of the conventional planar display apparatus shown in FIGS. 18 and 18A.

FIGS. 5 and 6 show another embodiment. In this embodiment, the insulating film 24 is formed on the entire surface of the conductive substrate 23. The parallel strip metal electrodes 9*a* and 10*a* similar to those in the conventional apparatus shown in FIG. 19 are disposed on the upper surface and the lower surface of the conductive substrate 23, respectively, as control electrodes in such a manner as to be orthogonal to each other, thereby constituting the control electrode portion 21. In this case, if a voltage not more than the voltage applied to the first control conductive film group 26 so as to turn it on is applied to the conductive substrate 23, no electrons are attached to the insulating film 24. This occurs in the same way as in the second embodiment, thereby preventing the charge-up effect.

Figures 7, 7A:
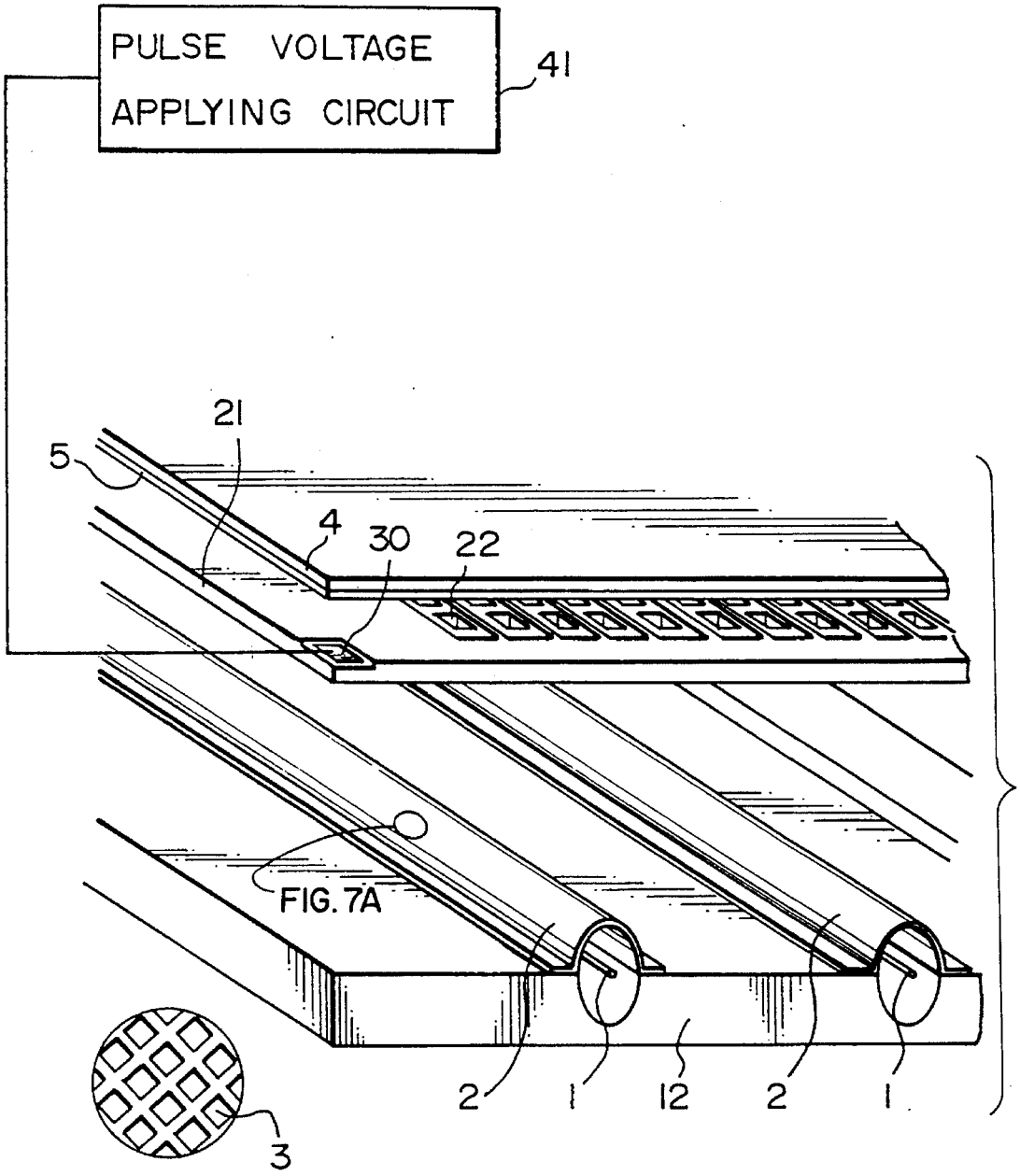
FIGS. 7 and 7A are a perspective view of a part of a third embodiment of a planar display apparatus according to the present invention.

FIGS. 7 and 7A show a third embodiment of a planar display apparatus according to the present invention. In this embodiment, a voltage applying means constituted by a pulse voltage applying device 41 for applying a pulse voltage having a predetermined value to the conductive substrate 23 is adopted as a means for effectively preventing the charge-up effect. The third embodiment is the same as the second embodiment shown in FIGS. 4 and 4A except for the pulse voltage applying device 41. The pulse voltage applying device 41 ordinarily applies 40 V, which is the same voltage as that applied to the first control conductive film group 26 in the on state, or 50 V to the conductive substrate 23. As described above, in order to display a picture, the conductive films 26*a* of the first control conductive film group 26 are consecutively turned on one by one. At this time, a voltage not less than 10 V lower than the voltage applied to the first control conductive film group 26 in the off state is applied to the conductive substrate 23 by the pulse voltage applying device 41 for a predetermined period immediately before the corresponding conductive film 26 is turned on. For example, if it is assumed that the voltage applied to the first control conductive film group 26 in the off state is −3 V, a voltage of −20 V is applied to the conductive substrate 23. The predetermined times for which the voltage of −20 V is applied to the conductive substrate 23 is 6 μsec between 6 μsec to 0 μsec before one conductive film 26*a* is turned on. In this way, the voltage of −20 V is applied to the conductive substrate 23 before each conductive film 26*a* is turned on.

When a voltage of −20 V is applied to the conductive substrate 23 in the form of a pulse in the above-described way, the electrons which have been attached to the substrate exposing portion 28 and the like are removed therefrom due to the electric field, and each conductive film 26*a* is turned on in the state free from those electrons. Consequently, the luminance is not lowered by the charge-up effect. Thus, it is possible to obtain a displayed screen with a desired luminance and a stable and uniform lightness.

Table 2 shows the results of experiments carried out by varying the thickness of the insulating film 24 and the voltage applied to the conductive substrate 23.

TABLE 2

| Thickness of insultating film (μm) | Pulse Voltage (V) | Evaluation |
|---|---|---|
| 150 | −20 | x |
| | −100 | x |
| 100 | 3 | x |
| | −8 | x |
| | −13 | o |
| | −30 | o |
| | −70 | o |
| | −100 | ◎ |
| 50 | 0 | o |
| | −8 | o |
| | −13 | ◎ |
| | −30 | ◎ |
| 30 | 0 | o |
| | −8 | ◎ |
| | −13 | ◎ |
| | −20 | ◎ |
| | −30 | ◎ |

It is obvious from Table 2 that the insulating film 24 is ineffective if the thickness thereof exceeds 100 μm, because the electric field from the conductive substrate 23 does not reach the surface of the insulating film 24. If the thickness is not more than 100 μm, especially, not more than 50 μm, the insulating film 24 is effective.

The pulse voltage applied to the conductive substrate 23 is effective if it is not less than 10 V lower than the voltage −3 V, which is applied to the first control conductive film group 26 in the off state, in other words if it is not more than −13 V. In these experiments, the control voltages applied to the first and second control conductive film groups 26 and 27 so as to turn them on were 40 V and 60 V, respectively, and the control voltage applied to them so as to turn them off was −3 V. The voltage applied to the porous cover electrodes 3 was 7 V.

The marks x, O and ◎ in the evaluation in Table 2 have the same meaning as in Table 1.

If the voltage applied to the conductive substrate 23 at a time other than the time when a pulse voltage is applied is increased, the display luminance tends to be enhanced. This effect is more prominent when the voltage applied exceeds the voltage applied to the first control conductive film group 26 in the on state. If the voltage applied exceeds the voltage applied to the second control conductive film group 27 in the on state, the charge-up effect preventing effect is slightly reduced. On the other hand, if the voltage applied to the conductive substrate 23 at a time other than the time when a pulse voltage is applied is reduced, the unevenness of the luminance, which is constantly caused probably be a slight number of electrons which are attached to the conductive substrate 23 after the application of the pulse voltage, becomes very small, but if the voltage becomes 0 V, or below, the lowering of the luminance is remarkable.

That is, while it is necessary to reduce the voltage applied to the conductive substrate 23 in order to reduce the charge-up effect, when the voltage applied is lowered, the luminance is also lowered. In this embodiment, since not a DC voltage but a pulse voltage is applied to the conductive substrate 23, as described above, it is possible to reduce the charge-up effect by applying a sufficiently low voltage which immediately removes the electrons adhered thereto while shortening the time for applying a low voltage which lowers the luminance. When a DC voltage which is low but does not influence the luminance is applied to the conductive substrate 23, the charge-up effect is reduced but the electrons once attached thereto are unlikely to be removed. For example, immediately after the making of the power source or during a long-time operation exceeding 24 hours, the charge-up effect is sometimes observed. In contrast, this embodiment in which a sufficiently low pulse voltage for providing a sufficient energy for removing the attached electrons is applied is effective.

Although a sufficiently low voltage is applied for a predetermined period immediately before the conductive film 26*a* is turned on in this embodiment, a similar effect is obtained even if the voltage is applied after the conductive film 26*a* is turned on. A special mode for removing the attached electrons may be provided such as a mode in which all the conductive films 26*a* of the first control conductive film group 26 are turned off while a sufficiently low voltage is applied. Although one period of pulse voltage is applied every time each conductive film 26*a* is turned on in this embodiment, the period may be increased to two or more, or may be reduced. In our experiments, a similar effect was observed when one period of pulse voltage was applied every time all the conductive films 26*a* of the first control conductive film group 26 are consecutively turned on (per frame). Although a period for applying a sufficiently low voltage is 6 μsec in this embodiment, the effect tends to become more prominent as the period becomes longer. On the other hand, a similar effect was observed when the period was set at 0.5 μsec.

The control voltages applied to the first and second control conductive film groups 26 and 27 so as to turn them on, the control voltage applied to them so as to turn them off, and the voltage applied to the porous cover electrodes shown in this embodiment are not restricted to 40 V, 60 V –3 V and 7 V, respectively. For example, when a voltage of 10 to 80 V and a voltage of 20 to 120 V were applied to the first control conductive film group 26 and the second control conductive film group 27, respectively, so as to turn them on, voltages of 0 to 120 V were applied to them independent of each other so as to turn them off and a voltage of 5 to 40 V was applied to the mesh electrode 3, similar effects were obtained in these experiments.

The effect of applying the pulse voltage to the conductive substrate 23 is not restricted to the third embodiment shown in FIGS. 7 and 7A. A similar effect is obtained by applying the pulse voltage to the conductive substrate 23 in the embodiment shown in FIGS. 5 and 6, in which the insulating film 24 is formed on the entire surface of the conductive substrate 23, and the parallel strip metal electrodes 9*a* and 10*a* are disposed on the upper surface and the lower surface of the conductive substrate 23, respectively, in such a manner as to be orthogonal to each other, thereby constituting the control electrode portion 21.

Figure 8:
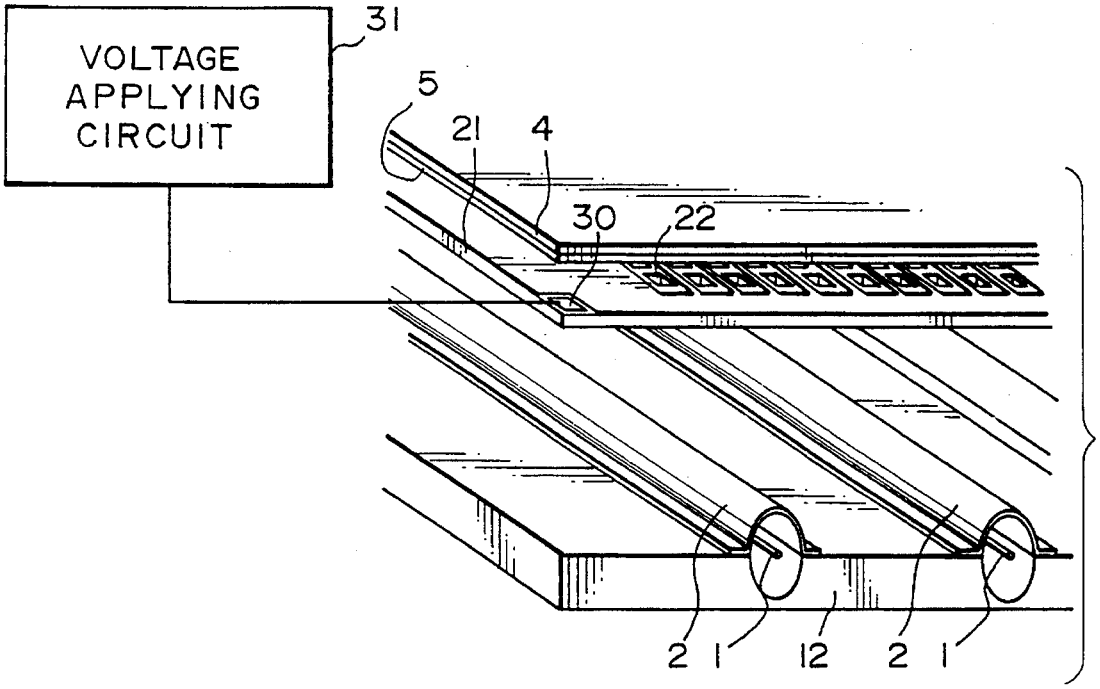
FIG. 8 is a perspective view of a part of a fourth embodiment of a planar display apparatus according to the present invention.
Figure 9:
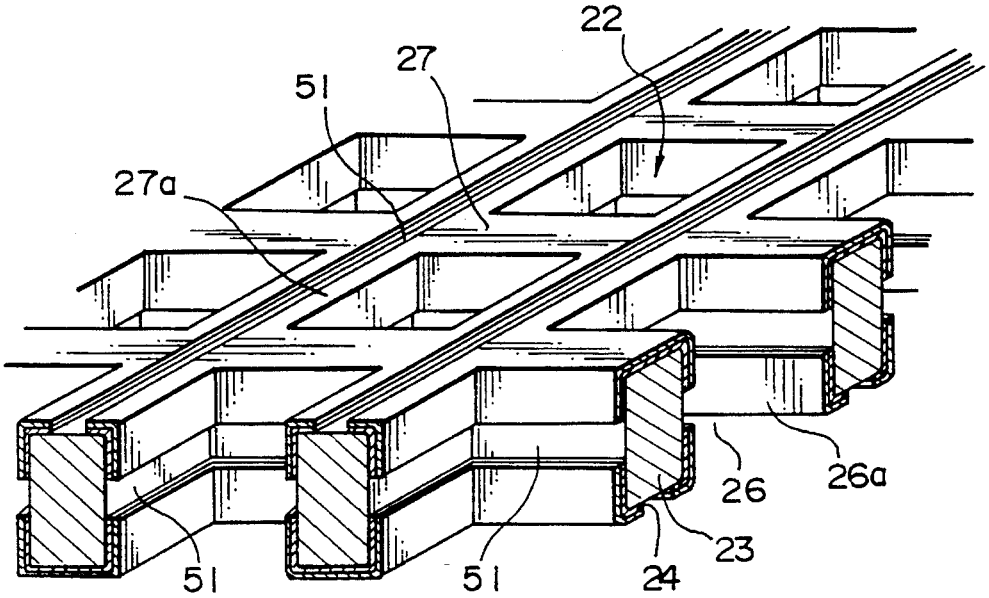
FIG. 9 is an enlarged partially sectional perspective view of the control electrode portion of the embodiment shown in FIG. 8.

Another embodiment of the present invention for preventing the charge-up effect will now be explained. FIGS. 8 and 9 show a fourth embodiment of the present invention. FIG. 9 is an enlarged partially sectional perspective view of the control electrode portion 21 in the embodiment shown in FIG. 8. In FIG. 8, the same numerals are provided for the elements which are the same as those shown in FIGS. 4 and 4A. In this embodiment, the insulating film 24 is formed only at the portions of the conductive substrate 23 on which the conductive films 26*a* and 27*a* are formed.

The first control conductive film group 26 is composed of a conductive film covering the undersurface of the conductive substrate 23 through the insulating film 24 and divided into a plurality of conductive films 26*a* in correspondence with the respective rows of the electron-passing holes 22. The conductive film is composed of a conductive material such as nickel. The second control conductive film group 27 is composed of a conductive film covering the upper surface of the conductive substrate 23 through the insulating film 24 and divided into a plurality of conductive films 27*a* in correspondence with the respective vertical lines of the electron-passing holes 22. The coating of the insulating film 24 with these first and second control conductive film groups 26 and 27 extends to the inside wall surfaces of the electron-passing holes 22.

The first and second control conductive film groups 26 and 27 are electrically isolated from each other. As described above, in each of the first and second control conductive film groups 26 and 27, the conductive films 26*a* on the adjacent rows or the conductive films 27*a* on the adjacent vertical lines are also electrically separated from each other. Owing to this structure, it is possible to apply different potentials to the conductive films 26*a* or 27*b* depending on the row or vertical line.

Figure 10:
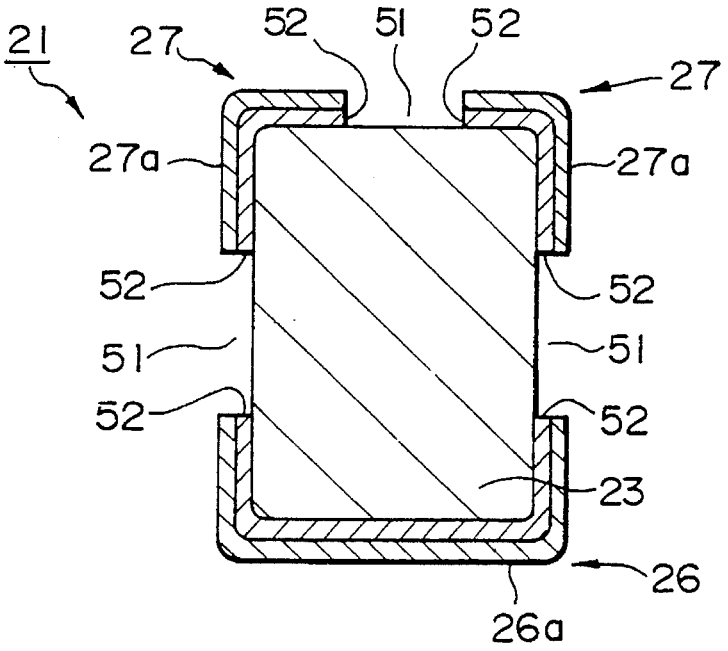
FIG. 10 is an enlarged sectional view of the control electrode portion shown in FIG. 9.

A conductor exposing portion 51 is formed between the conductor films 26 and 27 in each electron hole 22 and between the conductive film on every adjacent rows or vertical lines. FIG. 10 is an enlarged view of a part of the control electrode portion 21. As shown in FIG. 10, since the conductor exposing portions 51 are formed, the insulating films 24 are exposed only at their end portions 52. The thickness of the insulating film 24 is 30 μm.

In the planar display apparatus having the above-described structure, a voltage of 20 V is applied to the conductive substrate 23. The other voltage applying conditions are the same as in the embodiment shown in FIGS. 4 and 4A. In other words, the control voltages applied to the first and second control conductive film groups 26 and 27 so as to turn them on are 40 V and 60 V, respectively, and the control voltage applied to them so as to turn them off is –3 V.

If it is assumed that a voltage of 40 V is applied to the n-th conductive film 26*a* of the first control conductive film group 26 so as to turn on the conductive film 26*a*, the electrons only reach the vicinity of the conductive film 26*a* in the on state without reaching the conductive films 26*a* in the off state. A part of the electrons reach the end portions 52 of the insulating film 24 sandwiched between the conductive film 26*a* in the on state and the conductive substrate 23 on the undersurface of the control electrode portion 21 or in the electron hole 22, and a part of them adhere to the end portions 52 of this insulating film 24. However, since the end portion 52 of the insulating film 24 has a small width sandwiched between the conductors, the electrons adhered thereto are apt to move to the conductors in close proximity thereto. Therefore, the electron adhesion density is not large. In addition, since the exposed surface of the end portion 52 of the insulating film 24 is small, few electrons adhere thereto. Thus, the influence on the electrons which pass through the electron hole 22 is small. For these reasons, in this embodiment, the lowering of the luminance due to the charge-up effect is not caused, and it is possible to obtain a displayed screen with a desired luminance and a stable and uniform lightness.

Table 3 shows the results of experiments carried out by varying the thickness of the insulating film 24 in this structure.

TABLE 3

| Thickness of insulating film (μm) | Evaluation |
|---|---|
| 150 | x |
| 120 | ◎ |
| 100 | ◎ |
| 50 | ◎ |
| 30 | ◎ |

The marks x, O and ◎ in the evaluation in Table 3 indicate the same as in Table 1. It is obvious from Table 3 that the insulating film 24 is effective if the thickness thereof is not more than 120 μm.

The voltage applied to the conductive substrate 23 was 20 V, but the advantages of the present invention are brought about when the voltage of having a different value was applied. Especially, when the voltage is not more than 0 V, the a large effect is obtained.

The voltage applied to the conductive substrate 23 is not restricted to a constant voltage. For example, a voltage which periodically varies such as an AC voltage or a pulse voltage synchronous with the scanning of the first control conductive film group 26 may be adopted. However, it is necessary to maintain the conductive substrate 23 at a predetermined potential, and it is inconvenient to keep it in what is called an electrically floating state. This is because in this state, electrons are attached to the conductive substrate 23 itself and the conductive substrate gradually has a strongly negative potential, which makes it difficult for the electrons to pass through the electron-passing hole 22, thereby lowering the display luminance.

Figure 11:
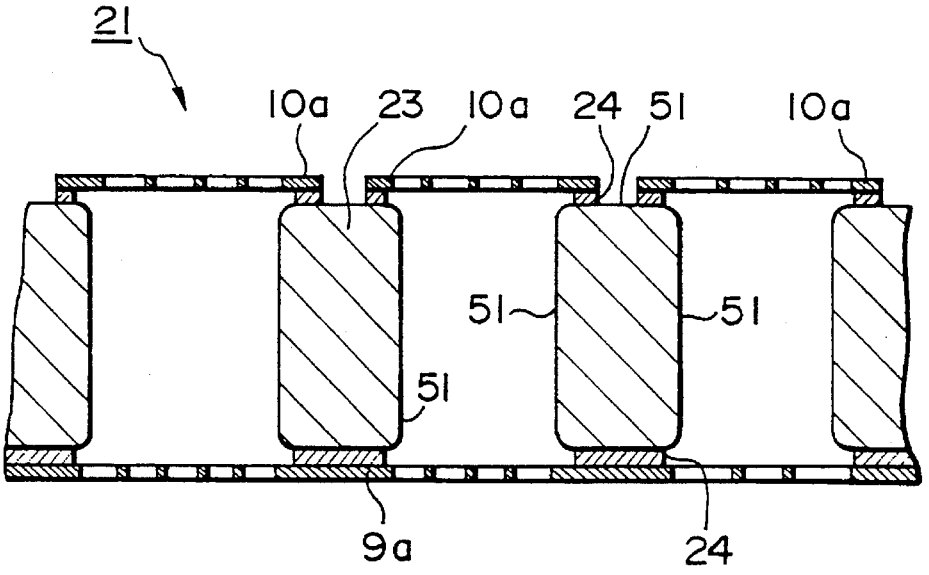
FIG. 11 shows the structure of still another embodiment of a planar display apparatus according to the present invention.

FIG. 11 shows still another embodiment. In this embodiment, the insulating film 24 is formed on the upper surface and the undersurface of the conductive substrate 23. The parallel strip metal electrodes 9*a* and 10*a*, similar to those in the conventional apparatus shown in FIG. 19, are disposed on the insulating film 24 as control electrodes in such a manner as to be orthogonal to each other, thereby constituting the control electrode portion 21. In this embodiment, the insulating film 24 is formed only at the portions which correspond to the metal electrodes 9*a* and 10*a*, and at the other portions, the conductor is exposed. A similar effect is obtained in this case.

In these two embodiments, the insulating film 24 is formed only at the portions at which the control electrodes are provided and the other portions are kept as the conductor exposing portions 51. However, it is also possible to form the conductor exposing portions 51 only at the portions which easily attract electrons, and the insulating films 24 are formed at the other portions. For example, there is substantially no problem in exposing the insulating film 24 between the conductive films 27*a* of the second control conductive film group 27 or the strip metal electrodes 10*a*. Furthermore, the insulating film 24 may be left exposed between the conductive films 26*a* of the first control conductive film group 26 or the strip metal electrodes 9*a*.

When a voltage of 10 to 80 V and a voltage of 20 to 120 V were applied to the first control conductive film group 26 and the second control conductive film group 27, respectively, so as to turn them on, voltages of 0 to −10 V were applied to them independent of each other so as to turn them off, and a voltage of 5 to 40 V was applied to the porous cover electrodes 3, similar effects were obtained.

Figure 12:
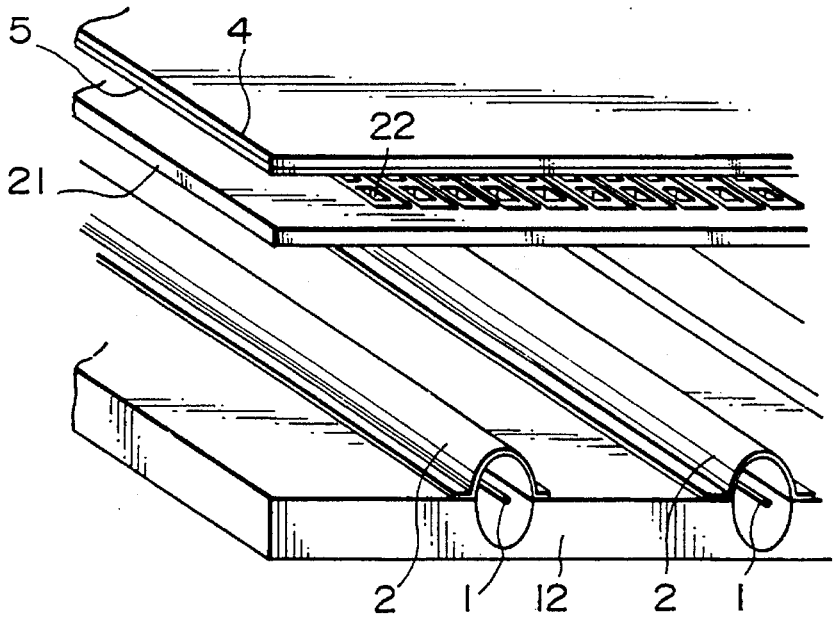
FIG. 12 is a perspective view of a part of a fifth embodiment of a planar display apparatus according to the present invention.
Figure 13:
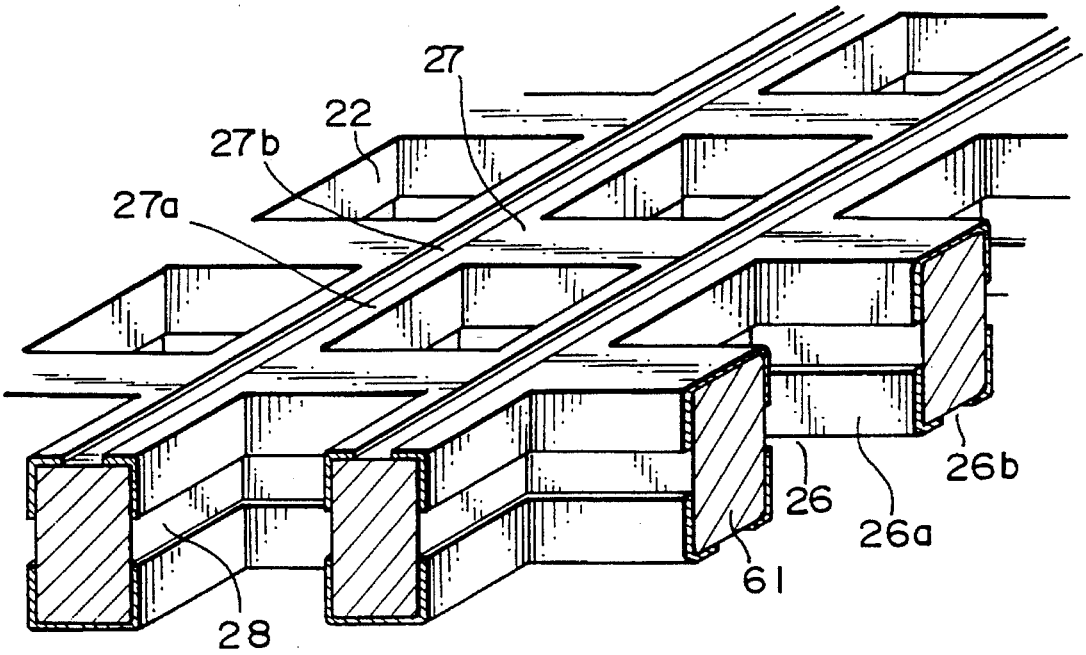
FIG. 13 is an enlarged partially sectional perspective view of the control electrode portion of the embodiment shown in FIG. 12.

A further embodiment of the present invention for preventing the charge-up effect will now be explained. FIGS. 12 and 13 show a fifth embodiment of the present invention. FIG. 12 is a perspective view of a part of a planar display apparatus and FIG. 13 is an enlarged partially sectional perspective view of a part of the control electrode portion 21 in the fifth embodiment.

In FIGS. 12 and 13, the numerals are provided for the elements are the same as those shown in FIG. 4. The reference numeral 61 represents an insulating substrate having the electron-passing holes 22 for passing electrons therethrough and composed of a ceramic material containing alumina as the main constituent. The first and second control conductive film groups 26 and 27 are formed on the insulating substrate 61 in the same way as in FIG. 2. The first control conductive film group 26 is composed of a conductive film covering the undersurface of the conductive substrate 23 and is divided into a plurality of conductive films 26*a* in correspondence with the respective rows of the electron-passing holes 22 so as to form the substrate exposing portions 26*b*. The second control conductive film group 27 is composed of a conductive film covering the upper surface of the conductive substrate 23 and divided into a plurality of conductive films 27*a* in correspondence with the respective vertical lines of the electron-passing holes 22 so as to form the substrate exposing portions 26*b*.

Figure 14:
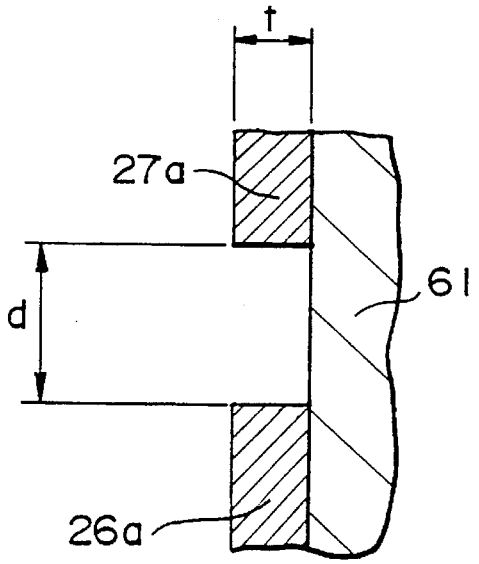
FIG. 14 is an enlarged sectional view of the control electrode portion of the control electrode portion shown in FIG. 13.

The thickness t of the conductive films 26*a* and 27*a* of the first and second control conductive film groups 26 and 27 is 10 μm. The space d between the conductive films 26*a* and 27*b* which are adjacent to each other in the electron-passing hole 22, the space d between the adjacent conductive films 27*a* on the upper surface of the control electrode portion 21 and the space d of the adjacent conductive films 27*a* on the undersurface of the control electrode portion 21 are equally 40 μm. FIG. 14 is an enlarged view of a part of the conductive films 26*a* and 27*a* which are adjacent to each other in the electron-passing hole 22.

In the planar display apparatus having the above-described structure, the voltage applying conditions are the same as in the embodiment shown in FIGS. 4 and 4A. In other words, the control voltages applied to the first and second control conductive film groups 26 and 27 so as to turn them on are 40 V and 60 V, respectively. The control voltage applied to them so as to turn them off is −3 V. Further, and the voltage applied to the porous cover electrodes 3 is 7 V.

If it is assumed that a voltage of 40 V is applied to the n-th conductive film 26*a* of the first control conductive film group 26 so as to turn on the conductive film 26*a*, the electrons only reach the vicinity of the conductive film 26*a* in the on state without reaching the conductive films 26*a* in the off state. The electrons enter the electron-passing hole 22 and a part of them reach the substrate exposing portion 28 in the electron-passing hole 22. Further, and a part of the electrons are attached to the substrate exposing portion 28.

However, since the substrate exposing portion 28 is separated from the orbit of electrons due to the thickness of the conductive films 26*a* and 27*a* and has a small width, the electrons do not easily reach the substrate exposing portion 28. Further, the electrons attached thereto are apt to move to the conductor films 26*a* and 27*a* in close proximity thereto. Therefore, the electron adhesion density is not large. In addition, since the substrate exposing portion 28 is separate from the orbit of electrons due to the thickness of the conductive film 26*a*, the electric field by the electrons adhered thereto has only a small influence on the electrons which pass the electron-passing hole 22.

For these reasons, in this embodiment, the lowering of the luminance due to the charge-up effect is not caused, and it is possible to obtain a display screen with a desired luminance and a stable and uniform lightness. The electric field of the electrons which are attached to the substrate exposing portion 28 is separate from the orbit of the electrons which pass the electron-passing hole 22, and it has only a small influence.

Table 4 shows the results of experiments carried out by varying the space d between the adjacent conductive films and the thickness t of the conductive film in this structure. In the evaluation, the mark x indicates that a change in the display luminance due to the charge-up effect was observed and the mark ⊚ indicates that no change in the display luminance was observed.

TABLE 4

| d (μm) | t (μm) | d/t | Evaluation | d | t (μm) | d/t (μm) | Evaluation |
|---|---|---|---|---|---|---|---|
| 150 | 150 | 1 | x | 50 | 20 | 2.5 | ⊚ |
| | 100 | 1.5 | x | | 10 | 5 | ⊚ |
| 100 | 100 | 1 | ⊚ | | 5 | 10 | x |
| | 30 | 3.3 | ⊚ | 40 | 20 | 2 | ⊚ |
| | 20 | 5 | ⊚ | | 10 | 4 | ⊚ |
| | 10 | 10 | x | | 7 | 5.7 | ⊚ |
| | | | | 25 | 5 | 5 | ⊚ |

It is obvious from Table 4 that if the conditions that $d/t \leqq 5$, and $d \leqq 100$ μm are satisfied, advantages are produced. As described above, the control voltages applied to the first and second control conductive film groups 26 and 27 so as to turn them on were 40 V and 60 V, respectively, and the control voltage applied to them so as to turn them off was −3 V. However, the advantages of the present invention tend to increase and become better than those in Table 4 when the difference in the control voltages applied to the first control conductive film group 26 and second control conductive film group 27 is large. Especially, if the difference in the control voltage is more than 20 V, the effect is unfailing. When a voltage of 10 to 80 V and a voltage of 20 to 120 V were applied to the first control conductive film group 26 and the second control conductive film group 27, respectively, so as to turn them on, voltages of 0 to −10 V were applied to them independently of each other so as to turn them off and a voltage of 5 to 40 V was applied to the porous cover electrodes 3, similar effects were obtained.

Although a ceramic plate containing alumina as the main constituent is used for the insulating substrate 61 in this embodiment, an insulating material such as glass or a conductive substrate provided with an insulating film thereon as in the embodiment shown in FIG. 2 may be used instead.

Figure 15:
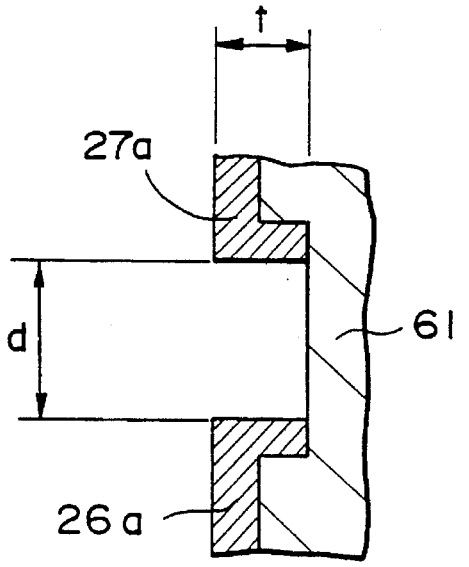
FIG. 15 is an enlarged sectional view of a modification of the control electrode portion shown in FIG. 14.
Figure 16A:
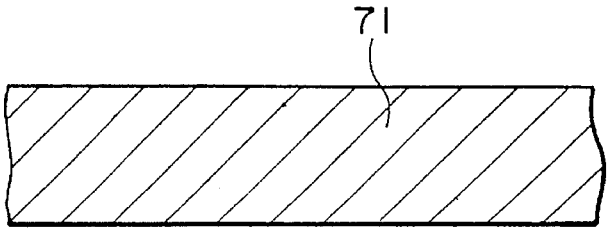
FIG. 16 is an explanatory view of the process for producing the control electrode portion in accordance with the present invention.
Figure 16B:
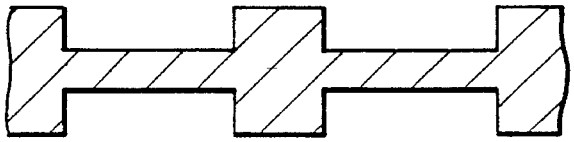
Figure 16C:
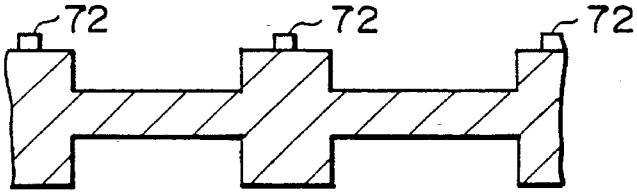
Figure 16D:
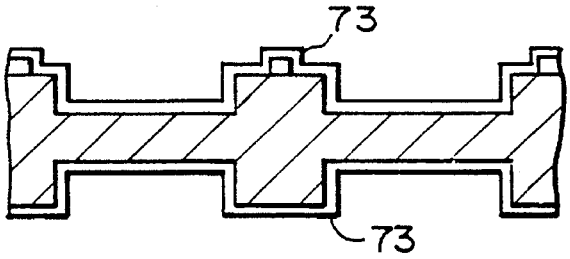
Figure 16E:
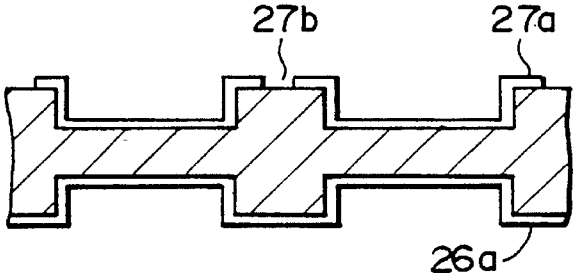
Figure 16F:
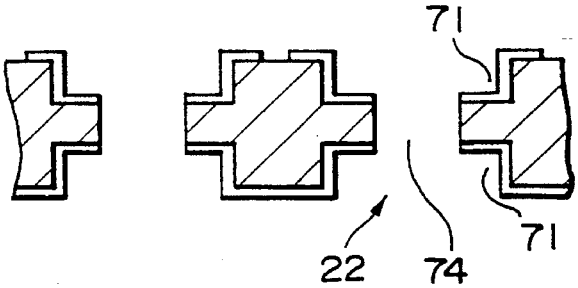

The control electrode is composed of the conductive film **26*a* having a uniform thickness t in this embodiment, but the same effect is produced by the control electrode having a height of t at the end portions. For example, when the control electrode is produced from a conductive film, the conductive film having a thickness thinner than t μm may be used such that the exposed substrate portion 28 of the insulating substrate 61 is recessed by about t μm and the side surfaces of the recess is also covered with the conductive film. This thereby constitutes the electrode having a height of substantially t μm at the end portions, as shown in FIG. 15**.

As described above, according to the present invention, it is possible to prevent a change in the display luminance caused by the charge-up effect.

Although the electron-passing hole 22 has a square shape in these embodiments, a similar effect is produced by the electron-passing hole 22 of a round or another shape. The electron emission source is not restricted to the one composed by the linear hot cathodes 1 and porous cover electrodes 2 shown in the embodiments, but any electron emission source that uniformly emits electrons to the control electrode portion 21 may be used. For example, small indirectly-heated cathodes arranged in a matrix or an array of cathodes utilizing electric field emission may be used instead.

A different structure of the control electrode portion 21 and an example of method of producing the same will be explained in the following. FIG. 16 is an explanatory view of the method of producing the control electrode portion 21. In this case, a free cutting ceramic substrate 71 is used as the surface insulated substrate. The free cutting ceramic substrate 71 is first drilled from both sides to make surface hole portions **71*a* of the electron-passing holes 22 while leaving the intermediate portions therebetween (step B). Resist layers 72 for dividing the first control conductive film group 26 and the second control conductive film group 27 into a plurality of conductive films 26*a* and 27*a*, respectively, each of which is electrically isolated from the conductive films 26*a* and 27*a* on the adjacent row and vertical line, respectively, are formed (step C). The entire surface of the ceramic substrate 71 provided with the resist layers 72 is covered with a metal such as copper so as to form a metal film (conductive film) 73 of about several μ thick (step D). The resist layers are then removed to obtain the conductive films 26*a*, 27*a* and substrate exposing portions 27*b* (step E). The intermediate portions left at the step B are then bored by, for example, electron beam boring, laser machining and machining so as to make through holes each having a smaller diameter than the surface hole portion 71*a* formed at the step B. In this way, the electron-passing holes 22, each being composed of the surface hole portions 71*a* and an inner hole portion 74**, are completed (step F).

The thus-produced electron-passing hole 22 scarcely obstructs the passage of electrons and electrically isolates the conductive film **27*a* on the upper surface from the conductive film 26*a* on the undersurface with safety. The conductive films 26*a* and 27*a* are capable of coating the ceramic substrate 71 including the inner wall surface of the electron-passing hole 22. This boring process, in which the surface hole portions 71*a* having a larger diameter are first formed, the conductive film 73 is next formed and the inner hole portions 74 are finally formed, enables the formation of the conductive film 73 and the electron-passing holes 22 with very good processability and the provision of the control electrode portion 21** having excellent insulating properties and high reliability.

A television set using such a planar display apparatus will now be explained. FIG. 17 is an exploded view of the structure of the television set. A planar display apparatus 81 is similar to the above-described embodiments. In FIG. 17, the reference numeral 82 is a surface of a sealed container having the front glass 4 and maintaining the interior thereof in a vacuum and sealed state. In the interior of the sealed container, the rear electrode 12, the linear hot cathodes 1, the porous cover electrodes 2, the control electrode portion 21, the converging electrode plate 29 are arranged. To these elements, appropriate voltages are applied by voltage applying circuits 83 to 86, respectively. When voltages are applied to the rear electrode 12, linear hot cathodes 1, porous cover electrodes 2 and the aluminum foil formed on the inner wall of the front glass 4, respectively, electrons are drawn out of the linear hot cathodes 1. By the voltage applied to the porous cover electrodes 2, the density of the electrons emitted from the linear hot cathode is made uniform, and by the voltage applied to the converging electrode plate 29, the electrons which have passed the control electrode portion 21 are converged. A control voltage for so controlling the amount of electron beam radiated on the phosphorescent substances 5 as to correspond to the picture to be displayed is applied to the control electrode portion 21 by a display control means 91. At the stage precedent to the display control means 91, a video.sound receiving circuit 92 is provided as a receiving means for receiving television waves. The display control means 91 is composed of a color signal reproducing circuit 93 and a driving circuit 94. The color signal reproducing circuit 93 reproduces a color signal containing a luminance signal on the basis of the receiving signal which is input from the video.sound receiving signal 92. The driving circuit 94 applies pulse control voltages to the conductive films 26*a* and 27*a* of the control electrode portion 21 on the basis of the color signal input from the color signal reproducing circuit 93. A sound circuit 95 reproduces a sound on the basis of the signal supplied from the video.sound signal receiving circuit 92.

In applying a control voltage to the control electrode portion 21 in the television set having the above-described structure, for example, a pulse voltage having a predetermined value is consecutively applied to the conductive films 26*a* (see FIG. 2) on each row and a pulse voltage having a predetermined value is applied to the conductive film 27*a* (see FIG. 2) on the vertical line on each row which corresponds to the picture element at which the phosphorescent substance 5 is caused to glow. A television picture is reproduced in this way. Thus, a thin television set is obtained.

As described above, according to the present invention, since a planar display apparatus comprises: an electron emission source for emitting electrons to a phosphor screen provided in a sealed container; and a control electrode portion interposed between the electron emission source and the phosphor screen and composed of a surface insulated substrate having a plurality of electron-passing holes and coated with a conductive film to which a passing electron controlling potential is applied and which is separated into a plurality of films, it is possible to form a highly reliable control electrode portion having a small hole diameter and a small hole pitch. Further, it is possible to produce a planar display apparatus which is capable of fine and accurate display without lowering the luminance.

If the conductive film is provided on the inner walls of the electron-passing holes to a depth of not less than ¼ of the diameter of the electron-passing holes, it is possible to produce a sufficient electric field in the electron-passing holes, thereby facilitating the control of the electrons passing therethrough.

The electron passing ratio and, hence, the display luminance are enhanced by coating the inner wall surfaces of the electron-passing holes with the material having a secondary-electron emission capacity larger than the insulated surface portion of the surface insulated substrate.

In addition, a focusing electrode plate provided between the phosphor screen and the control electrode portion converges the electrons which have passed through the control electrodes, thereby improving the picture quality such as the contrast.

If the surface insulated film is composed of a metal substrate provided with an insulation layer on the surface thereof, the processing is facilitated. If the material of the metal substrate has a linear expansion coefficient of not more than $3\times10^{-5}$/deg at a temperature of room temperature to about 500° C., it is possible to prevent the deterioration due to a temperature change during the manufacture or during use.

By applying a predetermined voltage to the conductive substrate by the voltage applying means, it is possible to provide the portions of the surface insulated substrate which are not coated with the control electrodes with a potential which makes it difficult to attach electrons thereto, thereby preventing the charge-up effect and enabling the production of a planar display apparatus which is capable of stable display without a change in the luminance.

If the voltage applying means applies to the conductive substrate with a pulse voltage, the lowest value of which is not less than 10 V lower than the lowest voltage of the passing electron controlling voltage which is applied to the control electrodes, it is possible to produce an electric field from the conductive substrate. This thereby separates the electrons which have been attached to the insulating film therefrom so as to prevent the charge-up effect and produce a planar display apparatus which is capable of stable display without a change in the luminance.

Since a conductor exposing portion at which the conductive substrate is exposed is provided between the adjacent control electrodes which are provided on the surface insulated substrate, electrons do not stay at the conductor exposing portions portions which are not covered with the control electrodes. Thus, the area of the portion at which electrons are stored is reduced. This thereby prevents a charge-up effect and enabling stable display without a change in the luminance.

By designing the control electrode so that the height t μm of the control electrode at the end portions and the space d μm between the adjacent control electrodes have the following relationship:

$$d/t \leqq 5,\ d \leqq 100,$$

the electrons which have been attached to the portions other than the control electrodes move to the control electrode situated in close proximity thereto. Further, in addition, the unnecessary electric field produced by the electrons attached to the portion is unlikely to reach the orbit of the passing electrons due to the thickness of the control electrodes. Thus, the lowering of the luminance due to the charge-up effect is prevented and stable display without a change in the luminance is enabled.

A control electrode is easily produced by the manufacturing process in which the surface hole portions are first formed while leaving the intermediate portion therebetween at which the inner hole portion is to be formed, the conductive film to which the passing electron controlling potential is applied is next formed and the inner hole portion is finally formed by piercing the intermediate portion from the surface hole portions.

In addition, by providing a receiving means for receiving television waves and a display control means for displaying the signal received by the receiving means on the planar display apparatus, it is possible to produce a thin planar television set which occupies only a small space.

While there has been described what are at present considered to a preferred embodiments of the invention, it will be understood that various modifications may be made thereto, and it is intended that the appended claims cover all such modifications as fall within the true spirit and scope of the invention.

What is claimed is:

1. A planar display apparatus comprising:

an electron emission source for emitting electrons to a phosphor screen provided on an inside surface of a sealed container;

a surface insulated substrate provided between said electron emission source and said phosphor screen and provided with a plurality of electron-passing holes; and control electrodes composed of a plurality of separate conductive films, said plurality of separate conductive films being formed on said surface insulated substrate and having a passing electron controlling potential applied thereto;

said surface insulated substrate being composed of a conductive substrate and an insulation layer provided on a surface of said conductive substrate;

said control electrodes being formed on said insulation layer;

said electron-passing holes each being composed of a pair of surface hole portions and an inner hole portion, one surface hole portion being provided on an upper surface and another surface hole portion being provided on an undersurface of said surface insulated substrate to a predetermined depth, said inner hole portion having a diameter which is smaller than diameters of said pair of surface hole portions;

said conductive films being formed on respective inner wall surfaces of said electron-passing holes.

2. A planar display apparatus comprising:

an electron emission source for emitting electrons to a phosphor screen provided on an inside surface of a sealed container;

a surface insulated substrate provided between said electron emission source and said phosphor screen and provided with a plurality of electron-passing holes; and control electrodes composed of a plurality of separate conductive films, said plurality of separate conductive films being formed on said surface insulated substrate and having a passing electron controlling potential applied thereto;

said surface insulated substrate being composed of a conductive substrate and an insulation layer provided on a surface of said conductive substrate;

said control electrodes being formed on said insulation layer;

said electron-passing holes each being composed of a pair of surface hole portions and an inner hole portion, one surface hole portion being provided on an upper surface and another surface hole portion being provided on an undersurface of said surface insulated substrate to a predetermined depth, said inner hole portion having a diameter which is smaller than diameters of said pair of surface hole portions.

3. The planar display apparatus according to claim 2, further comprising:

a focusing electrode provided between said phosphor screen and said control electrodes to focus the electrons which have passed through said control electrodes.

4. The planar display apparatus according to claim 2 wherein said conductive substrate is composed of a metal substrate.

5. The planar display apparatus according to claim 4, wherein said metal substrate has a linear expansion coefficient of not more than $3\times10^{-5}$/degree in a range of temperatures from room temperature to about 500° C.

6. A method of forming electron-passing holes and control electrodes in a planar display apparatus comprising the steps of:

(a) forming surface hole portions on both surfaces of an insulated substrate;

(b) forming conductive films on all surfaces of the surface insulated substrate including the surface hole portions, the conductive films forming the control electrodes; and (c) forming an inner hole portion in a pair of surface hole portions by boring a hole through one surface hole portion to another surface hole portion such that a diameter of the inner hole portion is smaller than diameters of the surface hole portions.

7. A planar display apparatus comprising:

an electron emission source for emitting electrons to a phosphor screen provided on an inside surface of a sealed container;

a surface insulated substrate provided between said electron emission source and said phosphor screen and provided with a plurality of electron-passing holes, said plurality of electron-passing holes having a larger secondary electron emission surface formed on inner wall surfaces thereof; and control electrodes composed of a plurality of separate conductive films formed on said insulated surface substrate and having a passing electron controlling potential applied thereto.

8. A television receiver comprising:

a receiver for converting incoming television signals into television picture signals;

a planar display apparatus for displaying television pictures; and display control means for controlling said planar display apparatus on the basis of said television picture signals applied from said receiver;

said planar display apparatus including, an electron emission source for emitting electrons to a phosphor screen provided on an inside surface of sealed container;

a surface insulated substrate provided between said electron emission source and said phosphor screen and provided with a plurality of electron-passing holes, and control electrodes composed of a plurality of-separate conductive films formed on said surface insulated substrate and having a passing electron controlling potential applied thereto;

said surface insulated substrate being composed of a conductive substrate and an insulation layer provided on a surface of said conductive substrate;

said control electrodes being formed on said insulation layer;

said electron-passing holes each being composed of a pair of surface hole portions and an inner hole portion, one surface hole portion being provided on an upper surface and another surface hole portion being provided on an undersurface of said surface insulated substrate to a predetermined depth, said inner hole portion having a diameter which is smaller than diameters of said pair of surface hole portions.

9. A planar display apparatus comprising:

an electron emission source for emitting electrons to a phosphor screen provide on the inside of a sealed container;

a surface insulated substrate composed of a conductive substrate;

said surface insulated substrate being provided between said electron emission source and said phosphor screen and provided with a plurality of electron-passing holes;

said surface insulated substrate also being composed of an insulating film formed on said conductive substrate;

control electrodes formed on said insulating film of said surface insulated substrate and having a passing electron controlling potential applied thereto; and voltage applying means for applying a predetermined voltage to said conductive substrate of said surface insulated substrate.

10. The planar display apparatus according to claim 9, wherein said voltage applying means applies a pulse voltage not less than 10 V and lower than a lowest voltage applied to said control electrodes.

11. A planar display apparatus comprising:

an electron emission source for emitting electrons to a phosphor screen provided on an inside surface of a sealed container;

a surface insulated substrate composed of a conductive substrate;

said surface insulated substrate being provided between said electron emission source and said phosphor screen and provided with a plurality of electron-passing holes;

said surface insulated substrate also being composed of an insulating film formed on said conductive substrate; and control electrodes formed on said insulating film of said surface insulated substrate and having a passing electron controlling potential applied thereto;

said surface insulated substrate being provided between adjacent control electrodes such that a portion of said conductive substrate is exposed;

said electron-passing holes each being composed of a pair of surface hole portions and an inner hole portion, one surface hole portion being provided on an upper surface and another surface hole portion being provided on an undersurface of said surface insulated substrate to a predetermined depth, said inner hole portion having a diameter which is smaller than diameters of said pair of surface hole portions.

* * * * *